US011222760B2

(12) United States Patent
Majima et al.

(10) Patent No.: US 11,222,760 B2
(45) Date of Patent: Jan. 11, 2022

(54) GAS CIRCUIT BREAKER

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Amane Majima, Kanagawa (JP); Tooru Inoue, Kanagawa (JP); Toshiyuki Uchii, Kanagawa (JP); Norimitsu Kato, Kanagawa (JP); Akira Shimamura, Kanagawa (JP); Takanori Yasuoka, Kanagawa (JP); Tsutomu Tanaka, Kanagawa (JP); Tadashi Mori, Kanagawa (JP)

(73) Assignees: KABUSHIKI KAISHA TOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 16/941,979

(22) Filed: Jul. 29, 2020

(65) Prior Publication Data

US 2020/0357586 A1 Nov. 12, 2020

Related U.S. Application Data

(63) Continuation of application No. PCT/JP2018/037132, filed on Oct. 4, 2018.

(51) Int. Cl.
*H01H 33/04* (2006.01)
*H01H 33/70* (2006.01)
*H01H 33/91* (2006.01)

(52) U.S. Cl.
CPC ..... *H01H 33/7023* (2013.01); *H01H 33/04* (2013.01); *H01H 33/7061* (2013.01); *H01H 33/91* (2013.01)

(58) Field of Classification Search
CPC ..... H01H 33/66261; H01H 33/666; H01H 2033/6623; H01H 2033/66284;
(Continued)

(56) References Cited

U.S. PATENT DOCUMENTS 3,745,284 A * 7/1973 Hosokawa ..... H01H 33/91 218/61
4,044,211 A * 8/1977 Cromer ..... H01H 33/91 218/64
(Continued)

FOREIGN PATENT DOCUMENTS

EP 2 991 092 A1 3/2016
JP S53-160762 A 12/1978
(Continued)

*Primary Examiner* — Truc T Nguyen
(74) *Attorney, Agent, or Firm* — Finnegan, Henderson, Farabow, Garrett & Dunner L.L.P.

(57) ABSTRACT

A gas circuit breaker of an embodiment includes a sealed container, a first contact part and a second contact part, an operation mechanism, an insulating nozzle, a pressure accumulator, and an electric field shield. The insulating nozzle is displaced in conjunction with the first contact part in a separation process of the first contact part and the second contact part. The insulating nozzle surrounds arc discharge generated between the first contact part and the second contact part. The electric field shield is attached to the insulating nozzle. The electric field shield has a floating potential during a period of at least part of the separation process. The electric field shield is electrically connected to the second contact part such that the electric field shield has the same potential in a completely open electrode state in which separation between the first contact part and the second contact part is terminated.

10 Claims, 19 Drawing Sheets

(58) Field of Classification Search
CPC ..... H01H 33/027; H01H 33/66207; H01H 33/7023; H01H 2033/6665; H01H 33/6661; H01H 33/04; H01H 33/70; H01H 33/7061; H01H 33/91; H01H 2033/66269; H01H 2033/66292; H01H 2033/6668; H01H 33/24; H01H 2033/146; H01H 33/6645; H01H 33/6647; H01H 1/38; H01H 2033/66276; H01H 33/7038; H01H 33/7069; H01H 1/0203; H01H 1/5822; H01H 2033/66215; H01H 31/003; H01H 33/596; H01H 33/66; H01H 33/664; H01H 39/006; H01H 51/2281; H01H 9/36; H01H 9/48
See application file for complete search history.

(56) References Cited

U.S. PATENT DOCUMENTS 4,086,461 A * 4/1978 Gonek ..... H01H 33/12 218/74
4,296,285 A * 10/1981 Lang ..... H01H 39/006 200/61.08
4,412,115 A * 10/1983 Okuno ..... H01H 33/7023 218/59
4,458,120 A * 7/1984 Korner ..... H01H 33/91 218/59
4,524,257 A * 6/1985 Slamecka ..... H01H 33/91 218/59
5,478,980 A * 12/1995 Freeman ..... H01H 33/91 218/59
2014/0174895 A1* 6/2014 Heiermeier ..... H01H 33/7038 200/275
2015/0060408 A1* 3/2015 Ono ..... H01H 33/91 218/57
2016/0005559 A1 1/2016 Kaneko et al.
2021/0261899 A1* 8/2021 Blanchard ..... C12M 23/22

FOREIGN PATENT DOCUMENTS

JP H10-269913 A 10/1998
JP H11-111127 A 4/1999
JP 2001-319551 A 11/2001
JP 2015-2142 A 1/2015
JP 2015-11875 A 1/2015
JP 2016-219317 A 12/2016
WO WO 2015/039918 A1 3/2015

* cited by examiner

GAS CIRCUIT BREAKER

CROSS-REFERENCE TO RELATED APPLICATION

This is a Continuation Application of International Application No. PCT/JP2018/037132, filed on Oct. 4, 2018, which claims priority to International Application No. PCT/2018/003582, filed on Feb. 2, 2018, and the entire contents of all of the aforementioned applications are incorporated herein by reference.

FIELD

An embodiment of the present invention relates to a gas circuit breaker.

BACKGROUND

A gas circuit breaker configured to perform turning on and off of a current in an electric power system mechanically separates contacts from each other in a breaking process and extinguishes an arc discharge between the contacts generated due to separating the contacts from each other by blowing of an arc-extinguishing gas. An example of the most common gas circuit breaker is called a puffer type. The puffer type gas circuit breaker boosts an arc-extinguishing gas using heat of arc discharge and blasts the arc-extinguishing gas with respect to the arc discharge while compressing the arc-extinguishing gas using a mechanical operating force.

In the puffer type gas circuit breaker, at least a pair of contacts are disposed facing each other in a sealed container which is filled with an arc-extinguishing gas, and the current is turned off by separating the contacts from each other in a state in which the contacts are in contact with each other and electrically conducting through a mechanical operation. Further, the puffer type gas circuit breaker includes a pressure accumulator configured to cause accumulation in pressure of an arc-extinguishing gas in a sealed container. The pressure accumulator includes a puffer chamber having a capacity that is reduced according to separation of the contacts.

Incidentally, in recent years, there have been demand for reduction in size and a lower driving energy for gas circuit breakers. However, when the gas circuit breaker is reduced in size, since the contacts are also reduced in size, an electric field concentration on the contacts also becomes significant. Moreover, when the puffer type gas circuit breaker is reduced in size, the capacity of the puffer chamber may be reduced, and blasting of the arc-extinguishing gas to the arc discharge may become insufficient. In addition, when driving energy of the gas circuit breaker is reduced, a separation speed of the contacts is reduced and insulation recovery characteristics between the contacts are deteriorated. Further, when the driving energy of the puffer type gas circuit breaker is reduced, pressure accumulation of the arc-extinguishing gas in the puffer chamber may be insufficient. Accordingly, when reduction in size and low driving energizing are achieved in the gas circuit breaker, insulation breakdown between the contacts is likely to occur in the current technology.

DETAILED DESCRIPTION

Figure 1:
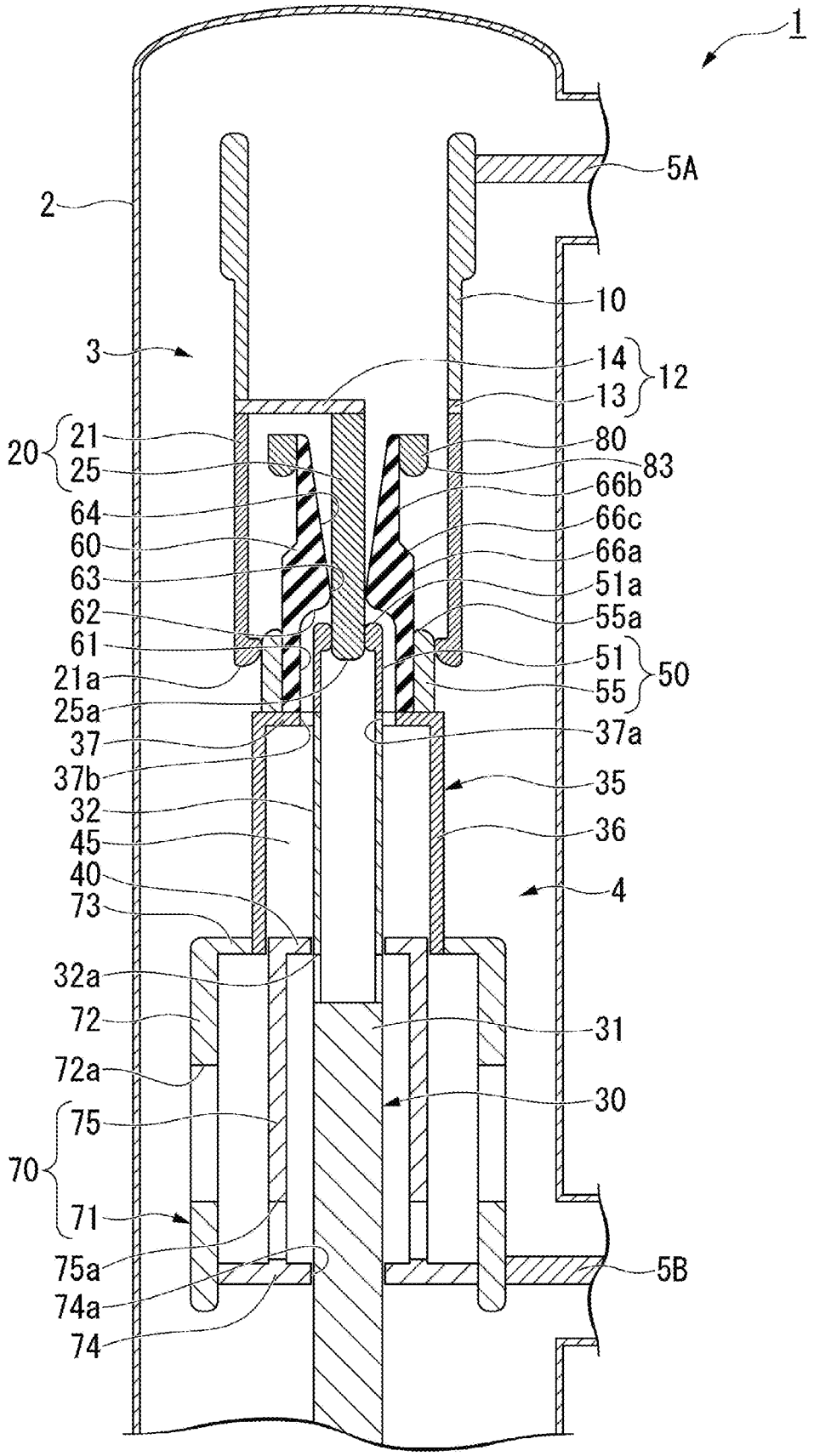
FIG. 1 is a cross-sectional view showing a gas circuit breaker of a first reference aspect.

A gas circuit breaker of an embodiment includes a sealed container, a first contact part and a second contact part, an operation mechanism, an insulating nozzle, a pressure accumulator, and an electric field shield. The sealed container is filled with an arc-extinguishing gas. The first contact part and the second contact part are provided to be able to come into contact with each other and be separated from each other in the sealed container in a predetermined direction. The first contact part and the second contact part are separated from each other in an open electrode state and come into contact with each other in a closed electrode state. The operation mechanism is connected to the first contact part. The operation mechanism separates the first contact part and the second contact part from each other in the closed electrode state to bring about the open electrode state. The insulating nozzle is formed in a tubular shape. The insulating nozzle is displaced in conjunction with the first contact part in the separation process of the first contact part and the second contact part. The insulating nozzle surrounds an arc discharge generated between the first contact part and the second contact part in the open electrode state. The pressure accumulator causes accumulation in pressure of the arc-extinguishing gas. The pressure accumulator discharges the arc-extinguishing gas to a flow path inside the insulating nozzle to perform blasting with respect to the arc discharge. The electric field shield is attached to the insulating nozzle. The electric field shield has a floating potential during a period of at least part of the separation process. The electric field shield is electrically connected to the second contact part such that the electric field shield has the same potential in a completely open electrode state in which separation between the first contact part and the second contact part has terminated.

Hereinafter, gas circuit breaking devices of reference aspects and embodiments will be described with reference to the accompanying drawings. Further, in the following description, the same reference numerals are designated to components having the same or similar functions. Thus, repeated description of these components can be omitted.

First Reference Aspect

Figure 2:
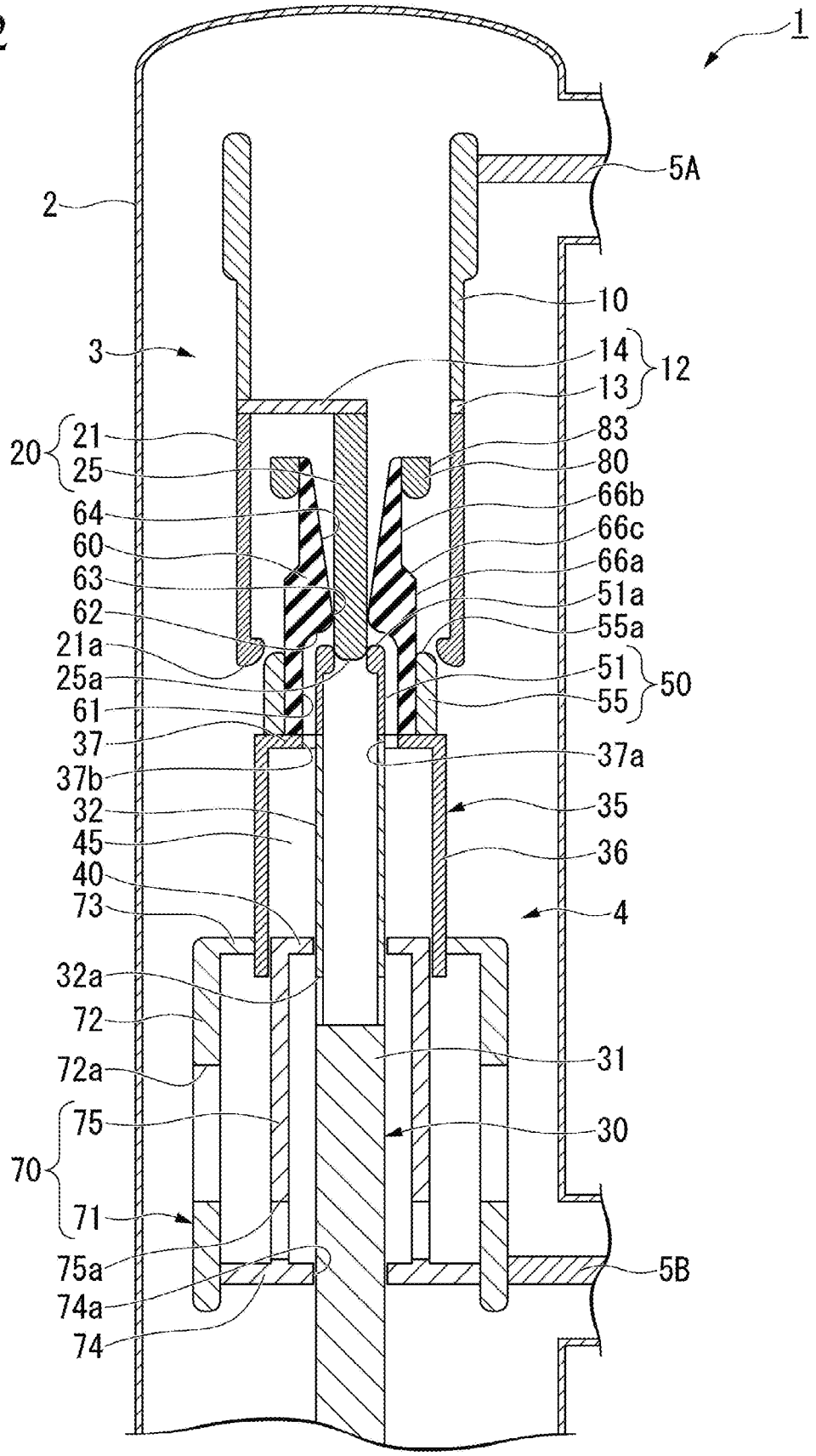
FIG. 2 is a cross-sectional view showing the gas circuit breaker of the first reference aspect.
Figure 3:
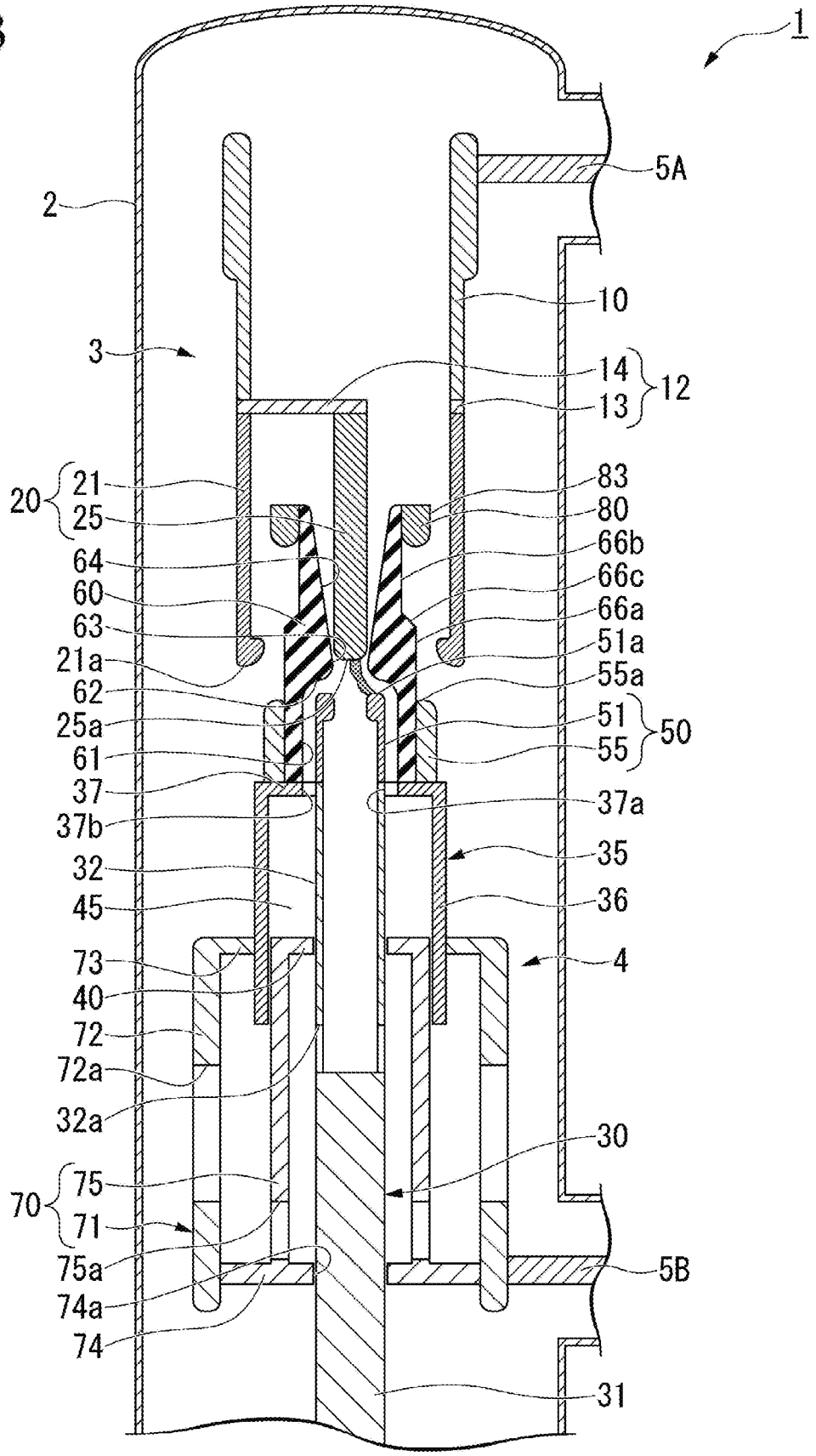
FIG. 3 is a cross-sectional view showing the gas circuit breaker of the first reference aspect.
Figure 4:
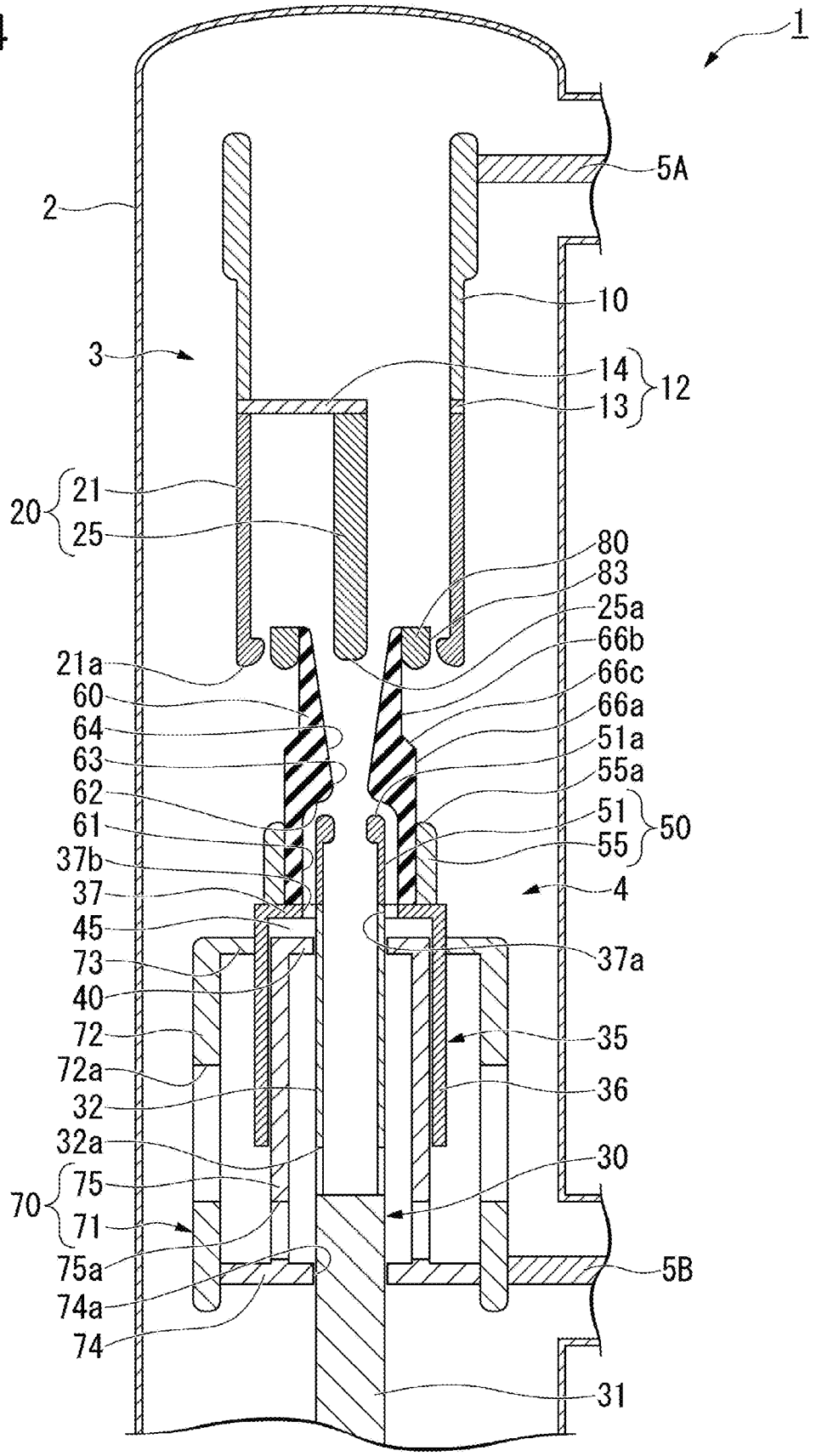
FIG. 4 is a cross-sectional view showing the gas circuit breaker of the first reference aspect.

FIGS. 1 to 4 are cross-sectional views showing a gas circuit breaker of a first reference aspect. Further, FIG. 1 shows a charging state of a gas circuit breaker 1, FIG. 2 shows immediately before opening in a closed electrode state of the gas circuit breaker 1, FIG. 3 shows an open electrode state of the gas circuit breaker 1, and FIG. 4 shows a completely open electrode state of the gas circuit breaker 1.

As shown in FIG. 1, the gas circuit breaker 1 is an opening/closing device configured to open and close an electric circuit of an electric power system. The gas circuit breaker 1 includes a sealed container 2 which is filled with an arc-extinguishing gas, and a counter unit 3 and a movable unit 4 disposed in the sealed container 2.

The sealed container 2 has an internal space in which cutoff of current flowing through the electric circuit is performed. The sealed container 2 is formed of a metal material. The sealed container 2 is grounded. A pair of conductors 5A and 5B are pulled into the sealed container 2 from outside of the sealed container 2.

The arc-extinguishing gas is a gas having an excellent extinguishing performance and insulating performance, and for example, may be sulfur hexafluoride ($SF_6$) gas. However, the arc-extinguishing gas may be a material having a smaller global warming potential than that of sulfur hexafluoride. A material having a smaller global warming potential than that of the sulfur hexafluoride is, for example, air, carbon dioxide, oxygen, nitrogen, a mixed gas thereof, or the like.

As shown in FIGS. 1 to 4, the counter unit 3 and the movable unit 4 constitute part of the electric circuit. The counter unit 3 includes a counter contact part 20 (a second contact part) electrically connected to the first conductor 5A. The movable unit 4 includes a movable contact part 50 (a first contact part) electrically connected to the second conductor 5B. The gas circuit breaker 1 opens and closes the electric circuit to electrically connect or disconnect the current by causing the counter contact part 20 and the movable contact part 50 to come into contact with or separate from each other. In the following description, a state in which the counter contact part 20 and the movable contact part 50 come into contact with each other is referred to as a closed electrode state, and a state in which the counter contact part 20 and the movable contact part 50 are separated from each other is referred to as an open electrode state. In addition, in the closed electrode state, a state applied to the case in which cutoff of the electric circuit is not required is particularly referred to as a charging state. In addition, in the open electrode state, a state in which a cutoff operation of the current is terminated is particularly referred to as a completely open electrode state. In addition, a process of separating the counter contact part 20 and the movable contact part 50 from each other from the charging state to the completely open electrode state is referred to as a separation process.

As shown in FIG. 1, each of the counter unit 3 and the movable unit 4 is constituted by a plurality of cylindrical or columnar members. The cylindrical or columnar members are disposed such that central axes thereof coincide with each other. The counter unit 3 and the movable unit 4 are disposed to face each other in an axial direction (a predetermined direction) of the central axis. Further, in the following description, the axial direction of the central axis is simply referred to as an axial direction. In addition, a direction around the central axis is referred to as a circumferential direction. In addition, a direction perpendicular to the central axis is referred to as a radial direction. In addition, in the description related to the counter unit 3, a direction in which the movable contact part 50 is separated from the counter contact part 20 when seen from the counter unit 3 in the axial direction is referred to as a movable side, and a direction opposite thereto is referred to as an anti-movable side. In addition, in the description related to the movable unit 4, a direction in which the counter contact part 20 is separated from the movable contact part 50 when seen from the movable unit 4 in the axial direction is referred to as a counter side, and a side opposite thereto is referred to as an anti-counter side.

The counter unit 3 includes a cooling tube 10, a support 12, and the counter contact part 20.

The cooling tube 10 is formed of a metal material in a cylindrical shape. Both ends of the cooling tube 10 are open in the axial direction. The cooling tube 10 is coupled and electrically connected to the first conductor 5A.

The support 12 is formed of a metal material. The support 12 includes a ring 13, and a protrusion 14 protruding inward from the ring 13 in the radial direction. The ring 13 formed to have substantially the same diameter as that of the cooling tube 10. The ring 13 is coupled to an end portion of the cooling tube 10 on the movable side. The protrusion 14 is formed integrally with the ring 13. A counter arc contact 25, which will be described below, is attached to a tip of the protrusion 14. The support 12 is electrically connected to the cooling tube 10.

The counter contact part 20 includes a counter conduction contact 21 and the counter arc contact 25.

The counter conduction contact 21 is formed of a metal material in a cylindrical shape. Both ends of the counter conduction contact 21 are open in the axial direction. The counter conduction contact 21 is formed such that it has the same diameter as that of the cooling tube 10. The counter conduction contact 21 is coupled to an end portion of the ring 13 of the support 12 on the movable side. An end portion 21*a* (a tip) of the counter conduction contact 21 on the movable side bulges inward in the radial direction. The counter conduction contact 21 is electrically connected to the cooling tube 10 via the support 12.

The counter arc contact 25 is formed of a metal material in a columnar shape. The counter arc contact 25 is disposed inside the counter conduction contact 21. The counter arc contact 25 is supported by the support 12 and extends from the protrusion 14 of the support 12 toward the movable side. An edge of an end portion 25*a* (a tip) of the counter arc contact 25 on the movable side is disposed slightly on the anti-movable side from the edge of the end portion 21*a* of the counter conduction contact 21 on the movable side. The end portion 25*a* of the counter arc contact 25 on the movable side has roundness. The counter arc contact 25 is electrically connected to the cooling tube 10 via the support 12.

The movable unit 4 includes an operation rod 30 (an operation mechanism), a cylinder 35, a piston 40, the movable contact part 50, an insulating nozzle 60, a support 70 and an electric field shield 80.

The operation rod 30 is formed of a metal material. The operation rod 30 includes a solid section 31 formed in a columnar shape, and a hollow section 32 formed in a cylindrical shape and continuously provided in the solid section 31. The solid section 31 is provided in the hollow section 32 on the anti-counter side. The solid section 31 is connected to the driving devices via an insulating rod (neither is shown) at an end portion on the anti-counter side, and can be displaced with respect to the sealed container 2 in the axial direction. An outer diameter of the hollow section 32 substantially coincides with an outer diameter of the solid section 31. An inner diameter of the hollow section 32 is larger than an outer diameter of the counter arc contact 25. An end portion of the hollow section 32 on the anti-counter side is closed by the solid section 31. An end portion of the hollow section 32 on the counter side is open toward the counter side. A first ventilation hole 32*a* that allows communication between the inside and the outside of the hollow section 32 in the radial direction is formed in the end portion of the hollow section 32 on the anti-counter side. The first ventilation hole 32*a* is disposed on the anti-counter side of the piston 40 in the charging state.

The cylinder 35 is formed of a metal material in a cylindrical shape. The cylinder 35 includes a circumferential wall 36 extending in the axial direction, and a bottom wall 37 continuously provided on an end portion of the circumferential wall 36 on the counter side. An inner diameter of the circumferential wall 36 is larger than an outer diameter of the operation rod 30. The circumferential wall 36 surrounds the operation rod 30 from an outward side in the radial direction. The bottom wall 37 overhangs inward from the end portion of the circumferential wall 36 on the counter side in the radial direction. A through-hole 37*a* through which the operation rod 30 is inserted is formed in a central section of the bottom wall 37. That is, the bottom wall 37 is formed in an annular plate shape. An inner diameter of the through-hole 37*a* is equal to an outer diameter of the operation rod 30. An end portion of the operation rod 30 on the counter side is inserted and fixed into the through-hole 37*a*. Accordingly, the cylinder 35 is electrically connected to the operation rod 30 while being fixed to the operation rod 30. The cylinder 35 is displaced in the axial direction in conjunction with the operation rod 30. An exhaust hole 37*b* passing therethrough in the axial direction is formed in an inner circumferential section of the bottom wall 37. In the reference aspect, the exhaust hole 37*b* is continuous with the through-hole 37*a*.

The piston 40 is disposed between the operation rod 30 and the circumferential wall 36 of the cylinder 35. The piston 40 is formed in an annular plate shape extending in both of the radial direction and the circumferential direction. An inner diameter of the piston 40 is equal to an outer diameter of the operation rod 30. An outer diameter of the piston 40 is equal to an inner diameter of the circumferential wall 36 of the cylinder 35. The piston 40 is fixed in position with respect to the sealed container 2 using the support 70.

The cylinder 35, the piston 40 and the operation rod 30 define a puffer chamber 45 (a pressure accumulator) configured to cause accumulation in pressure of the arc-extinguishing gas in a compressive manner. The puffer chamber 45 variably changes a capacity thereof in conjunction with the displacement of the operation rod 30. The puffer chamber 45 boosts the arc-extinguishing gas therein by reducing the capacity according to the displacement of the cylinder 35 and the operation rod 30 toward the anti-counter side. The arc-extinguishing gas boosted in the puffer chamber 45 is discharged from the puffer chamber 45 through the exhaust hole 37*b* of the cylinder 35.

The movable contact part 50 includes a movable arc contact 51 and a movable conduction contact 55.

The movable arc contact 51 is formed of a metal material in a cylindrical shape. Both ends of the movable arc contact 51 are open in the axial direction. The movable arc contact 51 is formed to have substantially the same diameter as that of the hollow section 32 of the operation rod 30. The movable arc contact 51 is coupled to the end portion of the hollow section 32 of the operation rod 30 on the counter side and electrically connected to the operation rod 30. An end portion 51*a* of the movable arc contact 51 on the counter side bulges inward in the radial direction. An inner diameter of the end portion 51*a* of the movable arc contact 51 on the counter side is equal to an outer diameter of the counter arc contact 25.

The movable arc contact 51 is displaced in the axial direction in conjunction with the operation rod 30. The counter arc contact 25 and the movable arc contact 51 are provided to come into contact with or separate from each other in the axial direction according to the displacement of the operation rod 30. The counter arc contact 25 and the movable arc contact 51 are separated from each other in the open electrode state while coming into contact with each other in the closed electrode state. The counter arc contact 25 and the movable arc contact 51 come into contact with and are electrically connected to each other when the counter arc contact 25 is inserted into the opening of the movable arc contact 51.

The movable conduction contact 55 is formed of a metal material in a cylindrical shape. The movable conduction contact 55 is disposed to surround the movable arc contact 51. The movable conduction contact 55 is provided to stand upright from the bottom wall 37 of the cylinder 35 on the counter side. The movable conduction contact 55 is electrically connected to the cylinder 35. An end portion of the movable conduction contact 55 on the counter side is open toward the counter side. An inner diameter of the movable conduction contact 55 is greater than an outer diameter of the movable arc contact 51. An outer diameter of the movable conduction contact 55 is equal to an inner diameter of the end portion 21*a* of the counter conduction contact 21 on the movable side. An edge of an end portion 55*a* of the movable conduction contact 55 on the counter side is disposed slightly closer to the anti-counter side than an edge of the end portion 51*a* of the movable arc contact 51 on the counter side. The end portion 55*a* of the movable conduction contact 55 on the counter side has roundness.

The movable conduction contact 55 is relatively fixed to the operation rod 30 via the cylinder 35. The movable conduction contact 55 is displaced in the axial direction in conjunction with the operation rod 30. The counter conduction contact 21 and the movable conduction contact 55 are provided to come into contact with each other and separate from each other in the axial direction according to the displacement of the operation rod 30. The counter conduction contact 21 and the movable conduction contact 55 are separated from each other in the open electrode state while coming into contact with each other in the charging state. The counter conduction contact 21 and the movable conduction contact 55 are separated from each other earlier than the counter arc contact 25 and the movable arc contact 51 in the separation process (see FIG. 2). The counter conduction contact 21 and the movable conduction contact 55 come into contact with and are electrically connected to each other as the movable conduction contact 55 is inserted into the opening of the counter conduction contact 21.

The insulating nozzle 60 is formed of an insulating material in a cylindrical shape. The insulating nozzle 60 is provided between the movable arc contact 51 and the movable conduction contact 55 to stand up from the bottom wall 37 of the cylinder 35 on the counter side. An end portion of the insulating nozzle 60 on the counter side is open toward the counter side. The insulating nozzle 60 is formed to be longer than the movable arc contact 51 and the movable conduction contact 55 on the counter side. That is, an edge of the insulating nozzle 60 on the counter side is disposed closer to the counter side than the edge of the end portion 51*a* of the movable arc contact 51 on the counter side and the edge of the end portion 55*a* of the movable conduction contact 55 on the counter side. The insulating nozzle 60 is provided at an interval from the movable arc contact 51 in the radial direction. The insulating nozzle 60 is close to an inner circumferential surface of the movable conduction contact 55 in the radial direction. The exhaust hole 37*b* of the cylinder 35 is open inside the insulating nozzle 60 in the radial direction. The insulating nozzle 60 surrounds an arc discharge, which will be described below, in the open electrode state. The insulating nozzle 60 guides the arc-extinguishing gas discharged from the puffer chamber 45 to an arc discharge, which will be described below.

The inside of the insulating nozzle 60 includes a parallel section 61, a diameter-reducing section 62, a slot section 63 and a diameter-enlarging section 64 in sequence in the axial direction. The parallel section 61 extends with a fixed inner diameter from the end portion of the insulating nozzle 60 on the anti-counter side. An end portion of the parallel section 61 on the counter side is disposed on an end portion of the movable arc contact 51 on the counter side at substantially the same position in the axial direction. The diameter-reducing section 62 extends such that the inner diameter gradually decreases from the end portion of the parallel section 61 on the counter side toward the counter side. The parallel section 61 and the diameter-reducing section 62 encircle the movable arc contact 51.

The slot section 63 is formed between the diameter-reducing section 62 and the diameter-enlarging section 64. The slot section 63 is a portion having a minimum inner diameter at the insulating nozzle 60. The end portion 25*a* of the counter arc contact 25 on the movable side passes through the slot section 63 in the separation process. An inner diameter of the slot section 63 is substantially equal to an inner diameter of the end portion 51*a* of the movable arc contact 51 on the counter side. The diameter-enlarging section 64 extends such that the inner diameter gradually increases from the slot section 63 toward the counter side. The inside of the insulating nozzle 60 forms a flow path for the arc-extinguishing gas discharged from the puffer chamber 45.

An outer circumferential surface of the insulating nozzle 60 includes a large diameter section 66*a*, a small diameter section 66*b* and an inclined section 66*c*. The large diameter section 66*a* is formed from an intermediate section of the insulating nozzle 60 to the end portion on the anti-counter side. The large diameter section 66*a* extends with a fixed outer diameter, and is close to the inner circumferential surface of the movable conduction contact 55. The small diameter section 66*b* is formed closer to the counter side than the large diameter section 66*a*. The small diameter section 66*b* is formed to have a smaller diameter than that of the large diameter section 66*a*, and extends with a fixed outer diameter. The inclined section 66*c* connects the end portion of the large diameter section 66*a* on the counter side and the end portion of the small diameter section 66*b* on the anti-counter side. The inclined section 66*c* is provided at the same position as that of the diameter-enlarging section 64 in the axial direction. The inclined section 66*c* has a diameter that is gradually reduced from the anti-counter side toward the counter side.

The support 70 includes a movable section support 71 and a piston support 75.

The movable section support 71 is formed of a metal material in a cylindrical shape. The movable section support 71 includes a circumferential wall section 72 extending in the axial direction, a brim section 73 overhanging inward from the end portion of the counter side of the circumferential wall section 72 in the radial direction, and a closing section 74 overhanging inward from the circumferential wall section 72 in the radial direction at a position closer to the anti-counter side than the brim section 73. An inner diameter of the circumferential wall section 72 is larger than an outer diameter of the cylinder 35. The brim section 73 is formed integrally with the circumferential wall section 72. The brim section 73 is disposed at the same position as that of the piston 40 in the axial direction. An inner diameter of the brim section 73 is equal to an outer diameter of the cylinder 35. The cylinder 35 is operated by being inserted through the brim section 73. The brim section 73 and the circumferential wall section 72 are electrically connected to the cylinder 35.

The closing section 74 is formed in a disk shape. The closing section 74 is fixed to an inner circumferential surface of the circumferential wall section 72. An insertion hole 74*a* through which the operation rod 30 is inserted is formed in a central section of the closing section 74. An inner diameter of the insertion hole 74*a* is equal to an outer diameter of the operation rod 30. The closing section 74 is disposed closer to the anti-counter side than the first ventilation hole 32*a* of the operation rod 30 in the completely open electrode state (see FIG. 4). The movable section support 71 is coupled and electrically connected to the second conductor 5B.

The piston support 75 is formed of a metal material in a cylindrical shape. The piston support 75 is provided to stand up from the closing section 74 of the movable section support 71 on the counter side. An outer diameter of the piston support 75 is equal to an inner diameter of the circumferential wall 36 of the cylinder 35. An inner diameter of the piston support 75 is greater than an outer diameter of the operation rod 30. The piston support 75 is continuous with the piston 40 at the end portion on the counter side. In the reference aspect, the piston support 75 is formed integrally with the closing section 74 of the movable section support 71 and the piston 40.

A second ventilation hole 72*a* passing in the radial direction is formed in the circumferential wall section 72 of the movable section support 71. The second ventilation hole 72*a* brings an external space of the movable section support 71 and an internal space between the circumferential wall section 72 of the movable section support 71 and the piston support 75 in communication with each other. In addition, a third ventilation hole 75*a* passing in the radial direction is formed in the piston support 75. The third ventilation hole 75*a* is formed in the vicinity of the end portion of the piston support 75 on the anti-counter side. The third ventilation hole 75*a* brings a space between the piston support 75 and the operation rod 30 and an internal space between the circumferential wall section 72 of the movable section support 71 and the piston support 75 in communication with each other.

The electric field shield 80 is attached to an end portion of the insulating nozzle 60 on the counter side. In the example shown, the electric field shield 80 is attached to the small diameter section 66*b* of the outer circumferential surface of the insulating nozzle 60. The electric field shield 80 is formed of a metal material in an annular shape concentric with the insulating nozzle 60. As a metal material that forms the electric field shield 80, for example, aluminum, an aluminum alloy, or the like, may be used. In addition, as a metal material that forms the electric field shield 80, a metal material containing at least magnesium may be used.

The electric field shield 80 is disposed between the counter conduction contact 21 and the counter arc contact 25 in the charging state. The electric field shield 80 is disposed between the end portion 21*a* of the counter conduction contact 21 on the movable side and the end portion 25*a* of the counter arc contact 25 on the movable side in the completely open electrode state (see FIG. 4). An end surface of the electric field shield 80 on the counter side is formed in a planar shape perpendicular to the axial direction. An end surface of the electric field shield 80 on the anti-counter side has roundness and bulges toward the anti-counter side. An outer diameter of the electric field shield 80 is smaller than an inner diameter of the counter conduction contact 21. Accordingly, the electric field shield 80 does not come into contact with the counter unit 3 even in any state from the charging state to the completely open electrode state. That is, the entire duration of the separation process is a non-contact period in which the electric field shield 80 does not come into contact with the counter conduction contact 21. The electric field shield 80 is a floating potential in the non-contact period in the separation process.

An insulating member 83 is disposed on a surface of the electric field shield 80. The insulating member 83 is an insulating layer that covers the surface of the electric field shield 80. An insulating material, for example, aluminum oxide ($Al_2O_3$), ethylene propylene (EP) rubber, tetrafluoroethylene/hexafluoropropylene copolymer (FEP), polyethylene terephthalate (PET), or the like may be used for the insulating member 83. The aluminum oxide can be formed by, for example, performing alumite treatment with respect to the electric field shield 80 formed of aluminum.

Next, a cutoff operation of the gas circuit breaker 1 will be described.

In the charging state, the movable conduction contact 55 is inserted into the counter conduction contact 21 and comes in contact therewith, and the counter arc contact 25 is inserted into the movable arc contact 51 and comes in contact therewith. Accordingly, the counter unit 3 and the movable unit 4 are electrically connected to each other, and a cable way is formed between the pair of conductors 5A and 5B.

The gas circuit breaker 1 displaces the operation rod 30 toward the anti-counter side and separates the counter contact part 20 and the movable contact part 50 from each other when current is cut off. When the operation rod 30 is displaced toward the anti-counter side, the movable arc contact 51, the movable conduction contact 55, the insulating nozzle 60 and the cylinder 35 are displaced toward the anti-counter side in conjunction with the operation rod 30. When the cylinder 35 is displaced toward the anti-counter side, a capacity of the puffer chamber 45 is reduced, and the arc-extinguishing gas in the puffer chamber 45 is pressurized.

As shown in FIG. 2, when the operation rod 30 is displaced from the charging state to the anti-counter side, the counter conduction contact 21 and the movable conduction contact 55 are separated from each other. In this state, since the counter arc contact 25 and the movable arc contact 51 come into contact with and electrically connected to each other, a cable way is formed between the pair of conductors 5A and 5B.

As shown in FIG. 3, when the operation rod 30 is displaced further toward the anti-counter side, the counter arc contact 25 and the movable arc contact 51 are separated from each other and shifted from the closed electrode state to the open electrode state. When the counter arc contact 25 and the movable arc contact 51 are separated from each other, arc discharge is generated between the counter arc contact 25 and the movable arc contact 51. When the arc discharge is generated, the arc-extinguishing gas therearound is heated and expanded. Some of the expanded arc-extinguishing gas flows into the puffer chamber 45. Accordingly, the arc-extinguishing gas in the puffer chamber 45 is further boosted.

When the cutoff operation progresses, a distance between the counter arc contact 25 and the movable arc contact 51 increases, and arc discharging is reduced as current is reduced toward a current zero point. When the arc discharge is reduced, flowing of the arc-extinguishing gas into the puffer chamber 45 is stopped, and a high pressure arc-extinguishing gas is discharged from the puffer chamber 45. The arc-extinguishing gas discharged from the puffer chamber 45 is blasted to the arc discharge through a flow path formed between the insulating nozzle 60 and the movable arc contact 51. Accordingly, the arc discharge is extinguished, and the current is cut off. Then, as shown in FIG. 4, the operation rod 30 is further displaced to the anti-counter side toward the completely open electrode state, and the cutoff operation is terminated. Further, a position of the operation rod 30 in the completely open electrode state is a position where the operation rod 30 is completely displaced to the anti-counter side by the driving device (not shown) connected to the operation rod 30.

As shown in FIG. 3, the arc-extinguishing gas blasted to the arc discharge is divided into a flow path on the side of the counter unit 3 and a flow path on the side of the movable unit 4 and discharged. The flow path on the side of the counter unit 3 reaches the inside of the sealed container 2 from the slot section 63 in the insulating nozzle 60 via the diameter-enlarging section 64 and an internal space of the cooling tube 10 in sequence. The flow path on the side of the movable unit 4 reaches the inside of the sealed container 2 from the opening of the movable arc contact 51 on the counter side via an internal space of the movable arc contact 51, a space between the piston support 75 and the operation rod 30, and a space between the circumferential wall section 72 of the movable section support 71 and the piston support 75 in sequence.

Figure 5:
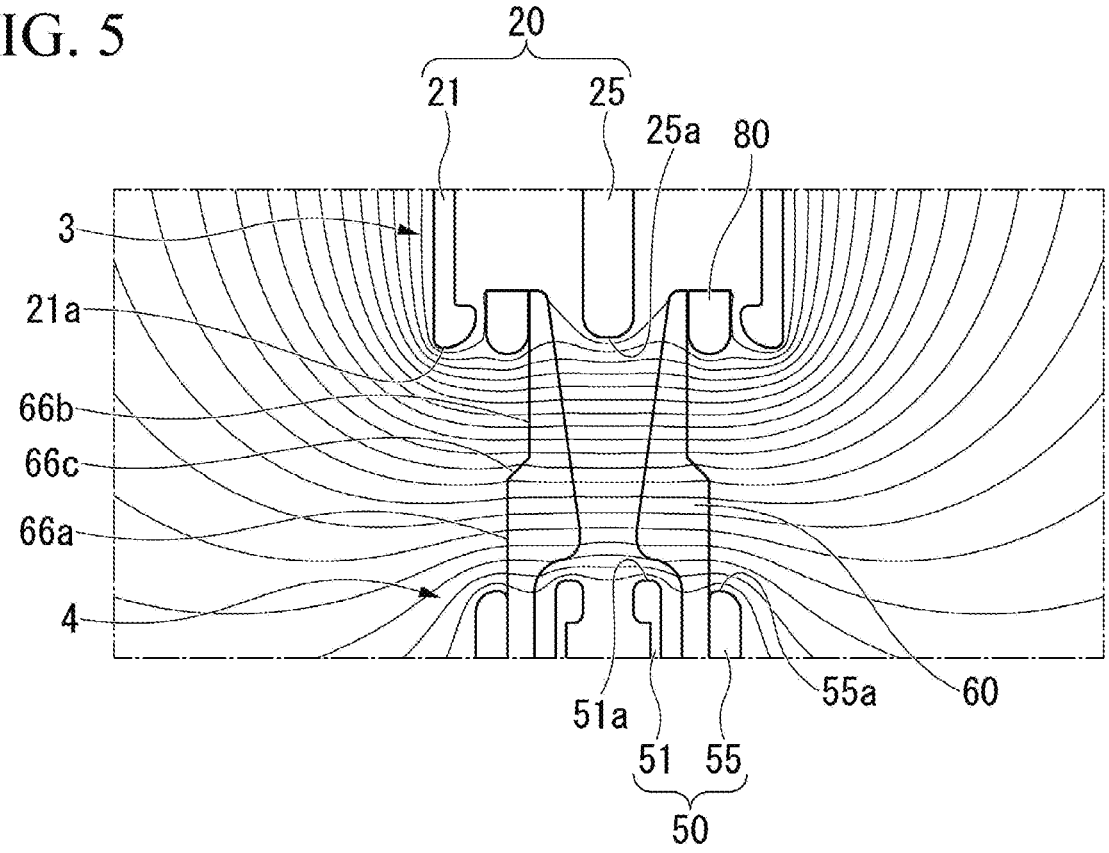
FIG. 5 is a view showing an example of an electric potential distribution in the gas circuit breaker of the reference example.
Figure 6:
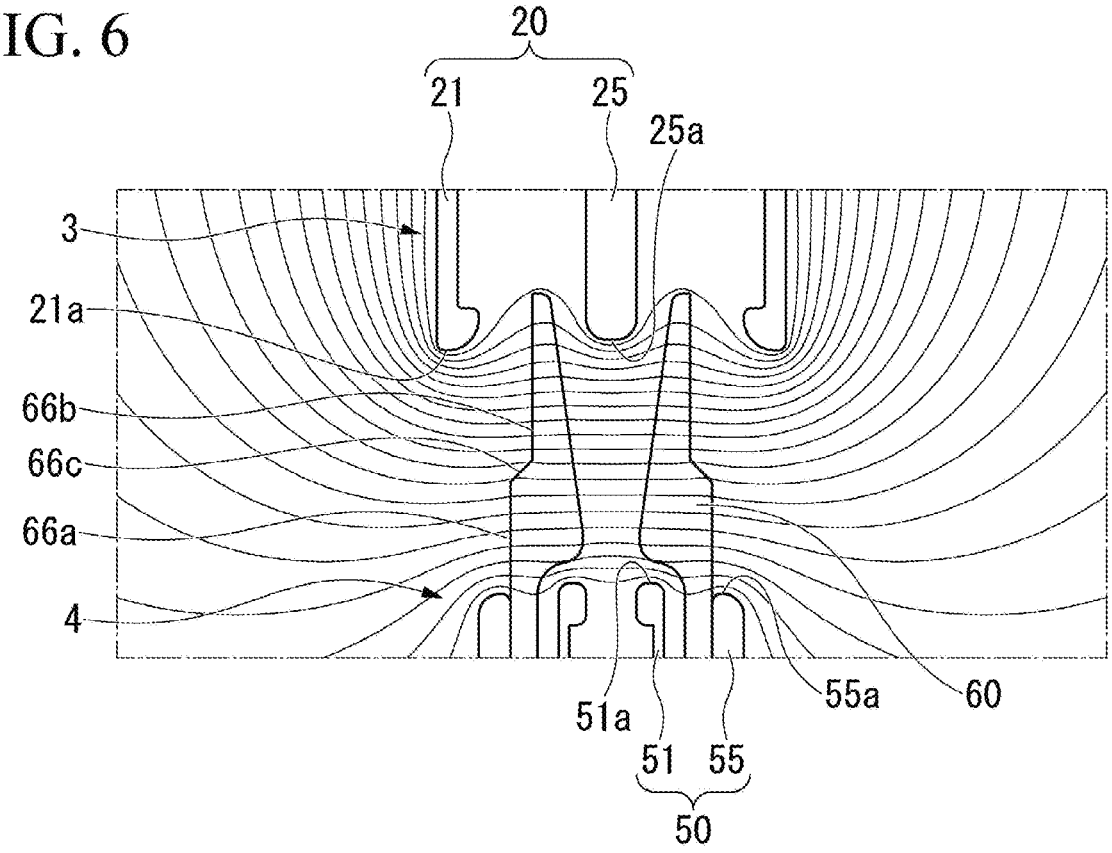
FIG. 6 is a view showing an example of an electric potential distribution in a gas circuit breaker of a comparative example.

FIG. 5 is a view showing an example of an electric potential distribution in the gas circuit breaker of the reference example. FIG. 6 is a view showing an example of an electric potential distribution in a gas circuit breaker of a comparative example. Further, the gas circuit breaker according to the reference example is the gas circuit breaker 1 of the reference aspect. In addition, in the gas circuit breaker according to the comparative example, the electric field shield 80 is omitted from the gas circuit breaker 1 according to the reference aspect. In FIGS. 5 and 6, the completely open electrode state is shown.

As shown in FIG. 6, in the gas circuit breaker of the comparative example, there are equipotential lines between the counter conduction contact 21 and the counter arc contact 25. Accordingly, in the insulating nozzle 60, the equipotential lines are disposed more densely in the vicinity of the end portion 25*a* of the counter arc contact 25 on the movable side than in other regions. That is, in the gas circuit breaker of the comparative example, the electric potential distribution in the insulating nozzle 60 is uneven, and insulation breakdown between the counter arc contact 25 and the movable arc contact 51 easily occurs. On the other hand, in the gas circuit breaker of the reference example shown in FIG. 5, the electric field shield 80 is disposed between the end portion 21*a* of the counter conduction contact 21 on the movable side and the end portion 25*a* of the counter arc contact 25 on the movable side. Accordingly, generation of the equipotential lines between the counter conduction contact 21 and the counter arc contact 25 is suppressed. As a result, in the insulating nozzle 60, in comparison with the comparative example shown in FIG. 6, the equipotential lines are disposed evenly in the axial direction. Accordingly, an electric field of the counter arc contact 25 is attenuated.

Figure 7:
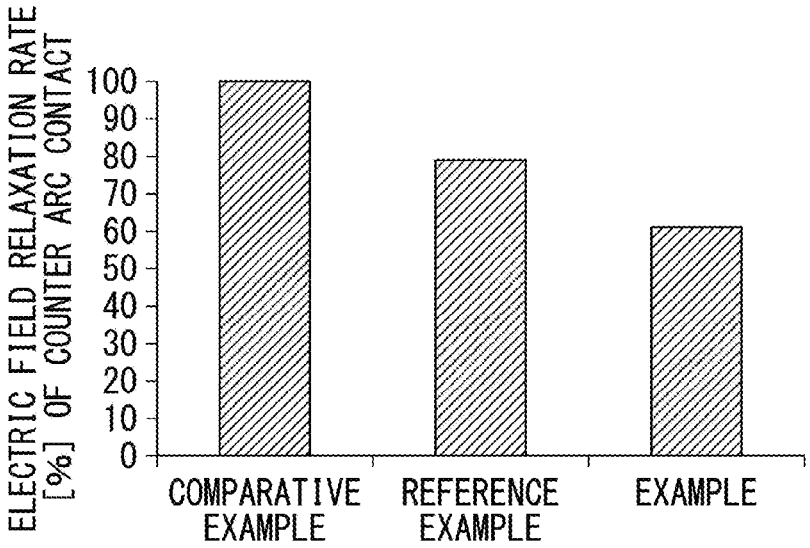
FIG. 7 is a graph showing an electric field of a counter arc contact.

FIG. 7 is a graph showing an electric field of the counter arc contact. FIG. 7 shows an electric field of the counter arc contact 25 in the completely open electrode state in the gas circuit breaker of each of the reference example and an example, which will be described below, when the electric field of the counter arc contact 25 in the completely open electrode state in the gas circuit breaker of the comparative example is 100.

As shown in FIG. 7, in the completely open electrode state, in the gas circuit breaker of the reference example, the electric field of the counter arc contact 25 can be attenuated to approximately 79% with respect to the comparative example. That is, since the electric field shield 80 is disposed between the end portion 21*a* of the counter conduction contact 21 on the movable side and the end portion 25*a* of the counter arc contact 25 on the movable side, the electric field of the counter arc contact 25 can be attenuated.

In the reference aspect, the gas circuit breaker 1 employs a configuration including the electric field shield 80 attached to the insulating nozzle 60. According to the configuration, the electric field in the insulating nozzle 60 can be attenuated by the electric field shield 80. Moreover, the electric field shield 80 has a floating potential in the entire period of the separation process. Accordingly, since the electric field shield 80 does not slide on the counter contact part 20 in the separation process, a force in a direction opposite to the moving direction such as a frictional force or the like is not received. For this reason, a decrease in moving speed of the movable contact part 50 operating integrally with the electric field shield 80 is suppressed. Accordingly, a decrease in separation speed between the counter contact part 20 and the movable contact part 50 is suppressed, and an insulating voltage between the counter contact part 20 and the movable contact part 50 can be rapidly increased. Accordingly, insulation breakdown between the counter contact part 20 and the movable contact part 50 can be suppressed, and current cutoff performance of the gas circuit breaker 1 can be improved.

Then, as described above, since the current cutoff performance of the gas circuit breaker 1 is improved, a blasting amount of the arc-extinguishing gas according to reduction in size of the puffer chamber 45 is reduced, and a decrease in pressure accumulation of the arc-extinguishing gas in the puffer chamber 45 according to reduction in driving energy is caused. Accordingly, it is possible to achieve reduction in size and low driving energizing of the gas circuit breaker 1.

Accordingly, it is possible to provide the gas circuit breaker 1 having excellent current cutoff performance and capable of achieving reduction in size and low driving energizing.

In addition, the electric field shield 80 is disposed between the end portion 21*a* of the counter conduction contact 21 on the movable side and the end portion 25*a* of the counter arc contact 25 on the movable side in the completely open electrode state. According to the configuration, in the completely open electrode state, the electric field of the counter arc contact 25 can be attenuated. Accordingly, the insulating-proof pressure in the completely open electrode state is improved, and the current cutoff performance of the gas circuit breaker 1 is improved. In addition, since the insulating-proof pressure in the completely open electrode state is improved, a distance between the counter arc contact 25 and the movable arc contact 51 in the completely open electrode state can be reduced, and the gas circuit breaker 1 can be reduced in size.

In addition, the insulating member 83 is disposed on the surface of the electric field shield 80. Accordingly, occurrence of insulation breakdown in the electric field shield 80 can be suppressed.

In addition, a load on the environment can be reduced by using a material having a smaller global warming potential than that of sulfur hexafluoride as the arc-extinguishing gas. Further, for example, the material having a smaller global warming potential than that of the sulfur hexafluoride may have an extinguishing performance and an electrical insulating performance that are worse than those of sulfur hexafluoride. However, since the current cutoff performance can be improved by applying the configuration of the reference aspect, even when a material having a smaller global warming potential that that of sulfur hexafluoride is used as the arc-extinguishing gas, a decrease in current cutoff performance can be suppressed.

In addition, since the electric field shield 80 is formed of a metal material containing magnesium, the electric field shield 80 can be reduced in weight in comparison with the case in which the electric field shield 80 is formed of aluminum. Accordingly, a decrease in moving speed of the movable contact part 50 operated integrally with the electric field shield 80 is suppressed. Accordingly, a decrease in separation speed between the counter contact part 20 and the movable contact part 50 can be suppressed and insulating-proof pressure between the counter contact part 20 and the movable contact part 50 can be rapidly increased.

Second Reference Aspect

Figure 8:
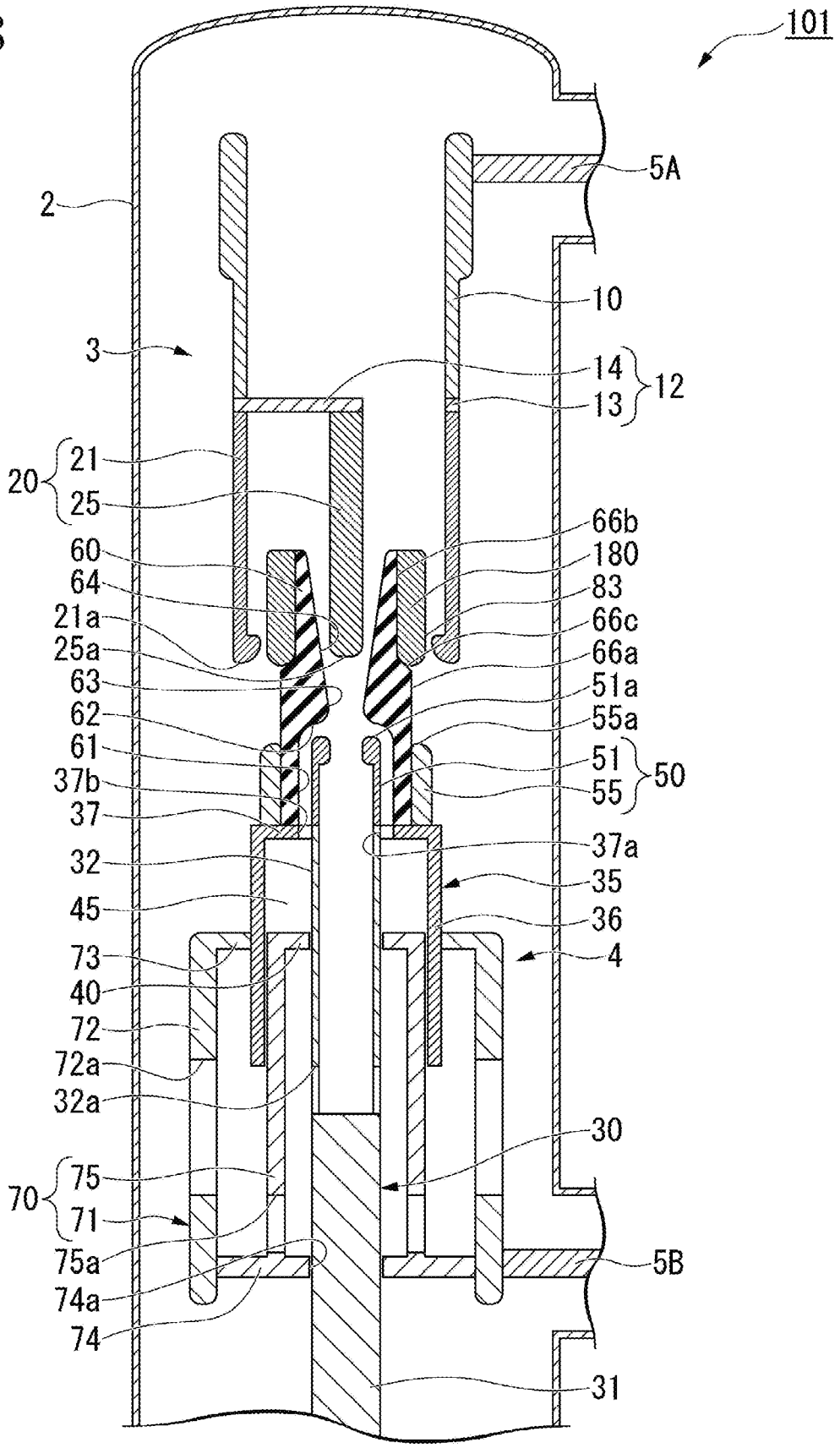
FIG. 8 is a cross-sectional view showing a gas circuit breaker of a second reference aspect.

FIG. 8 is a cross-sectional view showing a gas circuit breaker of a second reference aspect. Further, FIG. 8 shows an open electrode state of the gas circuit breaker 101.

The gas circuit breaker 101 of the second reference aspect shown in FIG. 8 is distinguished from the gas circuit breaker 1 of the first reference aspect in that an electric field shield 180 is attached to an intermediate section of the insulating nozzle 60 in the axial direction. Further, the configuration described below is otherwise the same as that of the first reference aspect.

As shown in FIG. 8, the gas circuit breaker 101 includes the electric field shield 180. The electric field shield 180 is formed in a cylindrical concentric with the insulating nozzle 60. The electric field shield 180 is attached to an outer circumferential surface of the insulating nozzle 60. The electric field shield 180 extends from the same position as the end portion of the insulating nozzle 60 on the counter side in the axial direction toward the anti-counter side. The electric field shield 180 is disposed between the end portion 21*a* of the counter conduction contact 21 on the movable side and the end portion 25*a* of the counter arc contact 25 on the movable side in the completely open electrode state from the middle of the separation process.

In the reference aspect, the electric field shield 180 is disposed between the end portion 21*a* of the counter conduction contact 21 on the movable side and the end portion 25*a* of the counter arc contact 25 on the movable side in a state in the middle of the separation process. According to the configuration, in the middle of the separation process, the electric field shield 180 passes through a space between the end portion 21*a* of the counter conduction contact 21 on the movable side and the end portion 25*a* of the counter arc contact 25 on the movable side. Accordingly, in an arbitrary state in the open electrode state, the electric field at the arbitrary position in the insulating nozzle 60 in the axial direction can be attenuated. Accordingly, the electric field shield 180 is disposed at a position where the electric field in a place in which the high temperature arc-extinguishing gas easily remains in the insulating nozzle 60 is attenuated, and the insulating-proof pressure in the state in the middle of the cutoff operation can be improved. Accordingly, the current cutoff performance of the gas circuit breaker 101 can be improved.

First Embodiment

Figure 9:
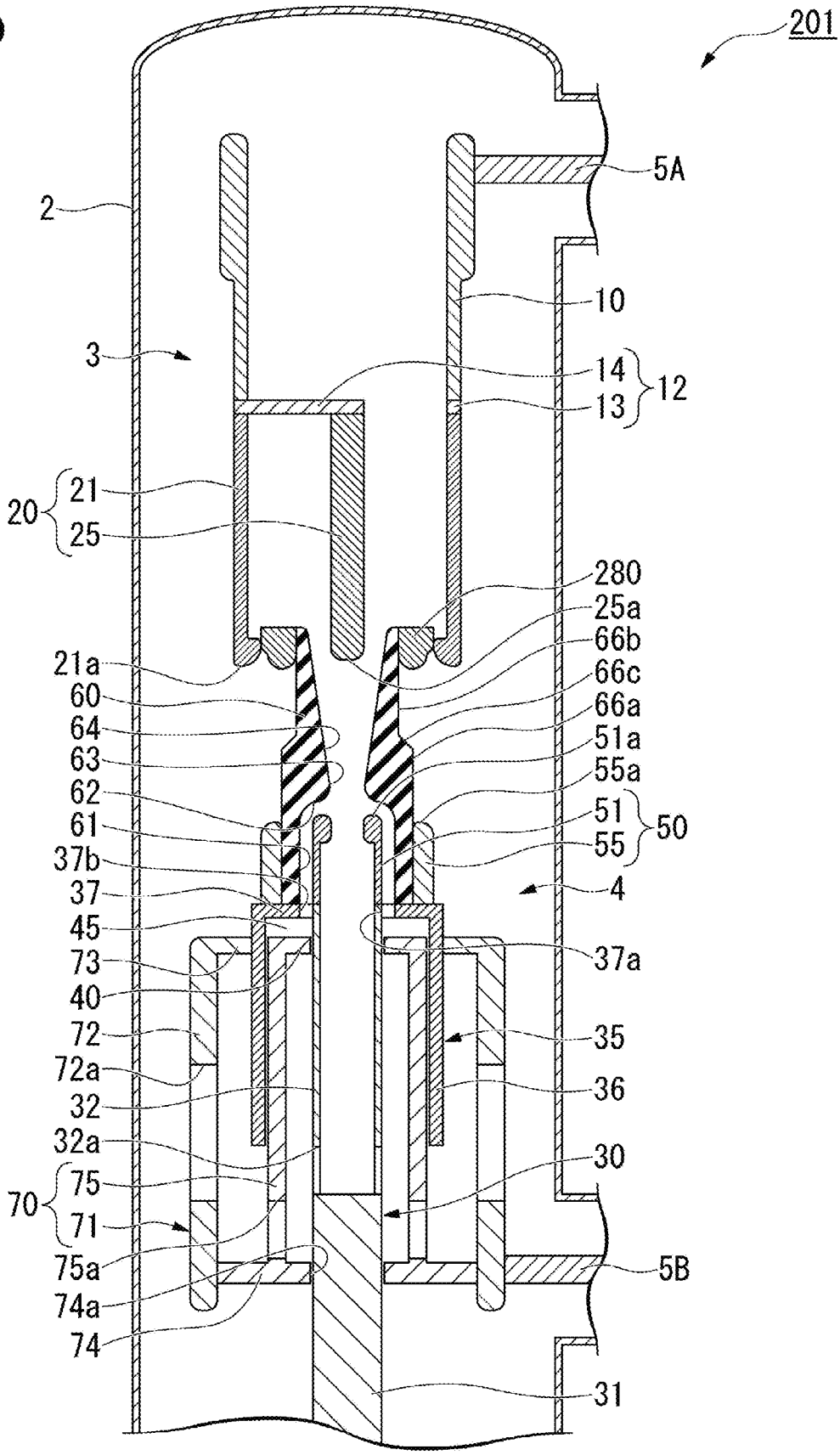
FIG. 9 is a cross-sectional view of a gas circuit breaker of a first embodiment.

FIG. 9 is a cross-sectional view showing a gas circuit breaker of a first embodiment. Further, FIG. 9 shows a completely open electrode state of a gas circuit breaker 201.

The gas circuit breaker 201 of the first embodiment shown in FIG. 9 is distinguished from the gas circuit breaker 1 of the first reference aspect in that an electric field shield 280 comes into contact with the counter conduction contact 21 in the completely open electrode state. Further, the other components described below are the same as those in the first reference aspect.

As shown in FIG. 9, the gas circuit breaker 201 includes the electric field shield 280. The electric field shield 280 is attached to the end portion of the insulating nozzle 60 on the counter side. The electric field shield 280 is disposed between the end portion 21*a* of the counter conduction contact 21 on the movable side and the end portion 25*a* of the counter arc contact 25 on the movable side in the completely open electrode state. An outer diameter of the electric field shield 280 is equal to an inner diameter of the end portion 21*a* of the counter conduction contact 21 on the movable side. Accordingly, the electric field shield 280 comes into contact with the inner circumferential surface of the counter conduction contact 21 only in the completely open electrode state. That is, a period of the separation process except a final step (the completely open electrode state) is a non-contact period in which the electric field shield 280 does not come into contact with the counter conduction contact 21. The electric field shield 280 has a floating potential in the non-contact period in the separation process while being electrically connected to the counter contact part 20 in the final step in the separation process such that it gains exactly the same potential. Further, electrically connected means that the electric field shield 280 and the counter contact part 20 are connected and electrically connected to each other. Specifically, the conduction means that the electric field shield 280 and the counter contact part 20 are electrically connected to each other via a direct contact therebetween or via a conductor that comes into contact with both of them.

Figure 10:
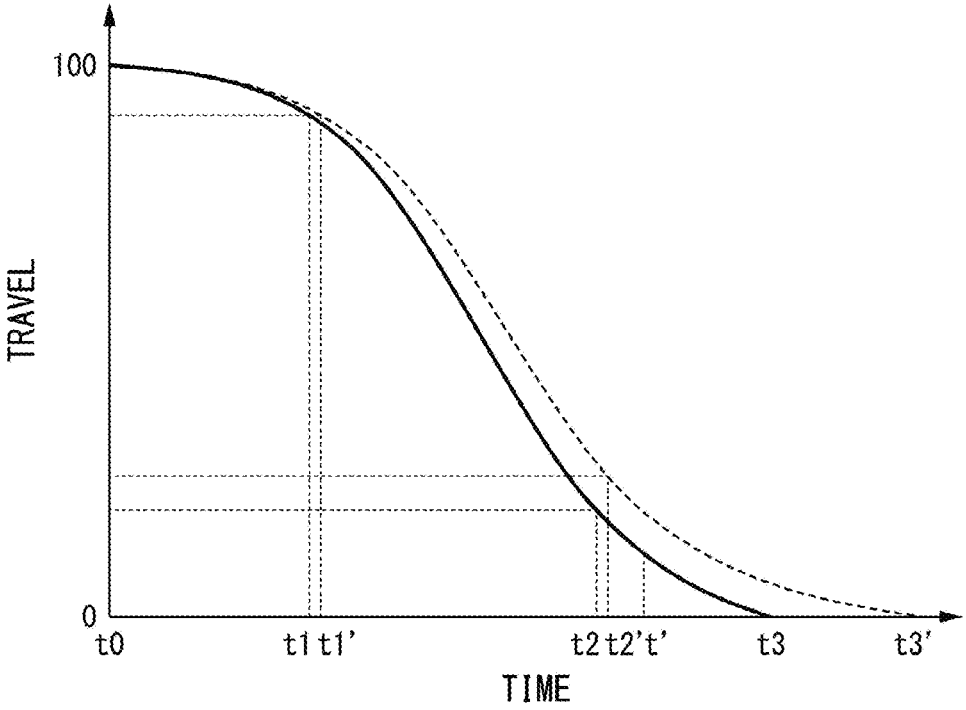
FIG. 10 is a graph showing a relationship between an elapsed time in a cutoff operation and a position of an operation rod.

FIG. 10 is a graph showing a relationship between an elapsed time and a position of an operation rod in a cutoff operation.

In FIG. 10, a horizontal axis is the elapsed time in the cutoff operation. A vertical axis is a position of the operation rod 30 in the axial direction, and a relative position when a position of the operation rod 30 in the completely open electrode state is 0 and a position of the operation rod 30 in the charging state is 100. In addition, a dotted line shows an electrode opening operation characteristics curve before the configuration of the embodiment is applied, and a solid line shows an electrode opening operation characteristic curve when the configuration of the embodiment is applied. In addition, a time t0 shows a cutoff operation starting time (the charging state), and times t1 and t1' show times when the counter arc contact 25 and the movable arc contact 51 are separated. In addition, times t2 and t2' show times when half a period according to commercial frequencies have elapsed after time t1 and t1'. In addition, the time t' shows a time when the electric field shield 280 and the counter conduction contact 21 come into contact with each other when the configuration of the embodiment is applied. In addition, the times t3 and t3' show the cutoff operation terminating time (the completely open electrode state).

As shown in FIG. 10, the time t' when the electric field shield 280 comes into contact with the counter conduction contact 21 is a time after the time t2, i.e., when a half cycle or more of the commercial frequency elapses from the time when the counter arc contact 25 and the movable arc contact 51 are separated from each other. That is, the electric field shield 280 has the same potential as that of the counter contact part 20 after a half cycle or more of the commercial frequency elapses from the time t1 when the counter arc contact 25 and the movable arc contact 51 are separated from each other. The electric field shield 280 does not come into contact with the counter contact part 20 until a half cycle or more of the commercial frequency elapses from the time t1 when the counter arc contact 25 and the movable arc contact 51 are separated from each other.

In addition, as shown in FIG. 10, since the configuration of the embodiment is applied, a moving speed of the operation rod 30 is improved. Accordingly, when the times t1 and t1' are compared, the counter arc contact 25 and the movable arc contact 51 can be rapidly separated from each other. As a result, the time when a half cycle of the commercial frequency elapses after the counter arc contact 25 and the movable arc contact 51 are separated from each other is shafted from t2' to t2. Accordingly, an opening electrode speed from the opening to the half cycle can be improved, and the insulating-proof pressure can be rapidly increased. The timing when the electric field shield 280 comes into contact with the counter contact part 20 can be made sooner. Accordingly, since the configuration of the embodiment is applied, the insulating-proof pressure between the counter contact part 20 and the movable contact part 50 can be more rapidly increased.

Figure 11:
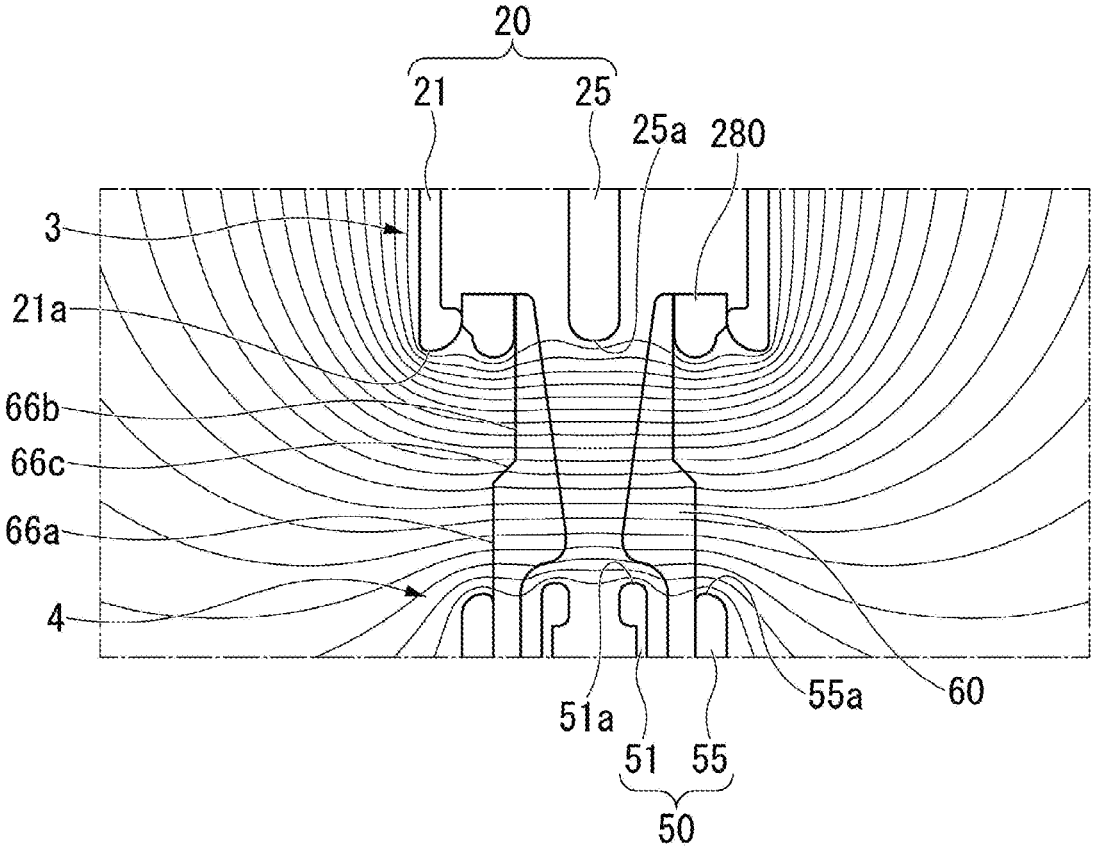
FIG. 11 is a view showing an example of an electric potential distribution in a gas circuit breaker of an example.

FIG. 11 is a view showing an example of an electric potential distribution in a gas circuit breaker of an example. Further, the gas circuit breaker according to the example is the gas circuit breaker 201 of the embodiment. FIG. 11 shows the completely open electrode state.

As shown in FIG. 11, in the gas circuit breaker of the example, the electric field shield 280 is disposed between the end portion 21*a* of the counter conduction contact 21 on the movable side and the end portion 25*a* of the counter arc contact 25 on the movable side. Since the electric field shield 280 has the same potential as those of the counter conduction contact 21 and the counter arc contact 25, in comparison with the reference example shown in FIG. 5, generation of the equipotential lines between the counter conduction contact 21 and the counter arc contact 25 can be further suppressed. Accordingly, in the insulating nozzle 60, in comparison with the comparative example shown in FIG. 6 and the reference example shown in FIG. 5, the equipotential lines are more uniformly disposed in the axial direction. Accordingly, the electric field of the counter arc contact 25 is attenuated.

As shown in FIG. 7, according to the example, since the electric field shield 280 is disposed between the end portion 21*a* of the counter conduction contact 21 on the movable side and the end portion 25*a* of the counter arc contact 25 on the movable side, the electric field of the counter arc contact 25 with respect to the comparative example can be attenuated to approximately 61%. In addition, the electric field of the counter arc contact 25 with respect to the reference example can be further attenuated.

According to the embodiment, the electric field shield 280 has the floating potential during the period of the separation process except the final step. Accordingly, since the electric field shield 280 does not slide to the counter contact part 20 during the period of the separation process except the final step, a force in a direction opposite to the moving direction such as a frictional force or the like is not received. For this reason, a decrease in moving speed of the movable contact part 50 operated integrally with the electric field shield 280 is suppressed. Accordingly, a decrease in separation speed between the counter contact part 20 and the movable contact part 50 can be suppressed, and the insulating-proof pressure between the counter contact part 20 and the movable contact part 50 can be rapidly increased. Accordingly, the insulation breakdown between the counter contact part 20 and the movable contact part 50 can be minimized, and the current cutoff performance of the gas circuit breaker 201 can be improved.

In addition, the electric field shield 280 is electrically connected to the counter contact part 20 such that it has the same potential in the completely open electrode state. Accordingly, in comparison with the configuration in which the electric field shield has the floating potential in the completely open electrode state, the electric field of the counter arc contact 25 can be further attenuated. Accordingly, the insulating-proof pressure in the completely open electrode state is improved, and the current cutoff performance of the gas circuit breaker 201 is improved. In addition, since the insulating-proof pressure in the completely open electrode state is improved, the distance between the counter arc contact 25 and the movable arc contact 51 in the completely open electrode state can be reduced, and the gas circuit breaker 201 can be reduced in size.

In addition, the electric field shield 280 comes into contact with the counter conduction contact 21 in the completely open electrode state. Accordingly, the electric field shield 280 and the counter contact part 20 can be electrically connected to each other without providing a new member. Accordingly, an increase in the number of parts the gas circuit breaker 201 can be minimized.

In addition, the electric field shield 280 has the same potential as that of the counter contact part 20 after a half cycle or more of the commercial frequency elapses from the time t1 when the counter contact part 20 and the movable contact part 50 are separated from each other in the separation process. The electric field shield 280 does not come into contact with the counter contact part 20 until a half cycle of the commercial frequency from the time t1 when the counter arc contact 25 and the movable arc contact 51 are separated from each other. Accordingly, since the electric field shield 280 does not slide to another member during a period to the time t2 when a half cycle of the commercial frequency elapses from the time t1, a decrease in moving speed of the operation rod 30 is prevented. Accordingly, a decrease in separation speed of the counter contact part 20 and the movable contact part 50 during a period to the time t2 is suppressed, and the insulating-proof pressure between the counter contact part 20 and the movable contact part 50 can be rapidly increased. Accordingly, insulation breakdown due to a recovery voltage applied after cutoff of a small current can be suppressed, and the cutoff performance can be improved.

Second Embodiment

Figure 12:
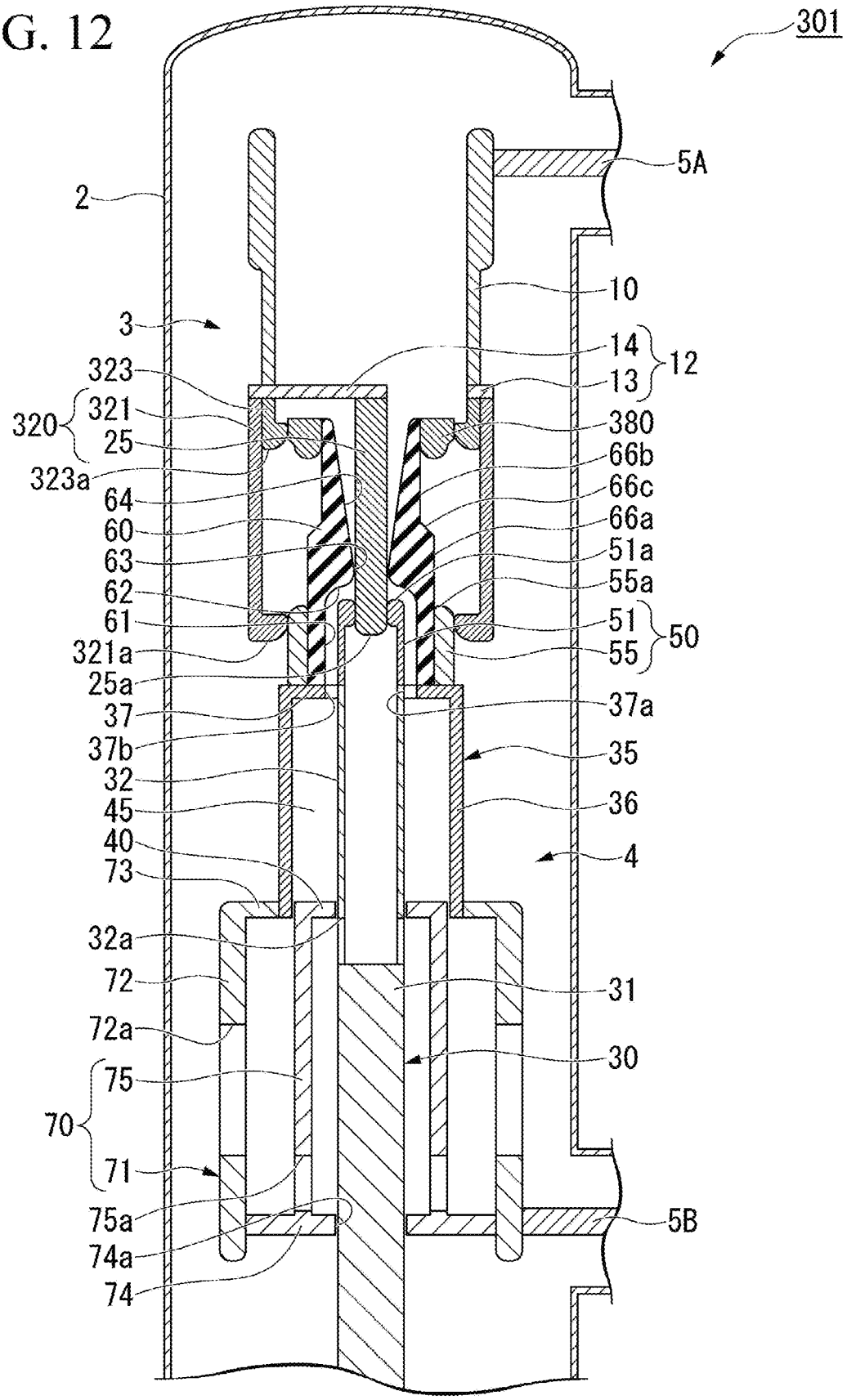
FIG. 12 is a cross-sectional view showing a gas circuit breaker of a second embodiment.
Figure 13:
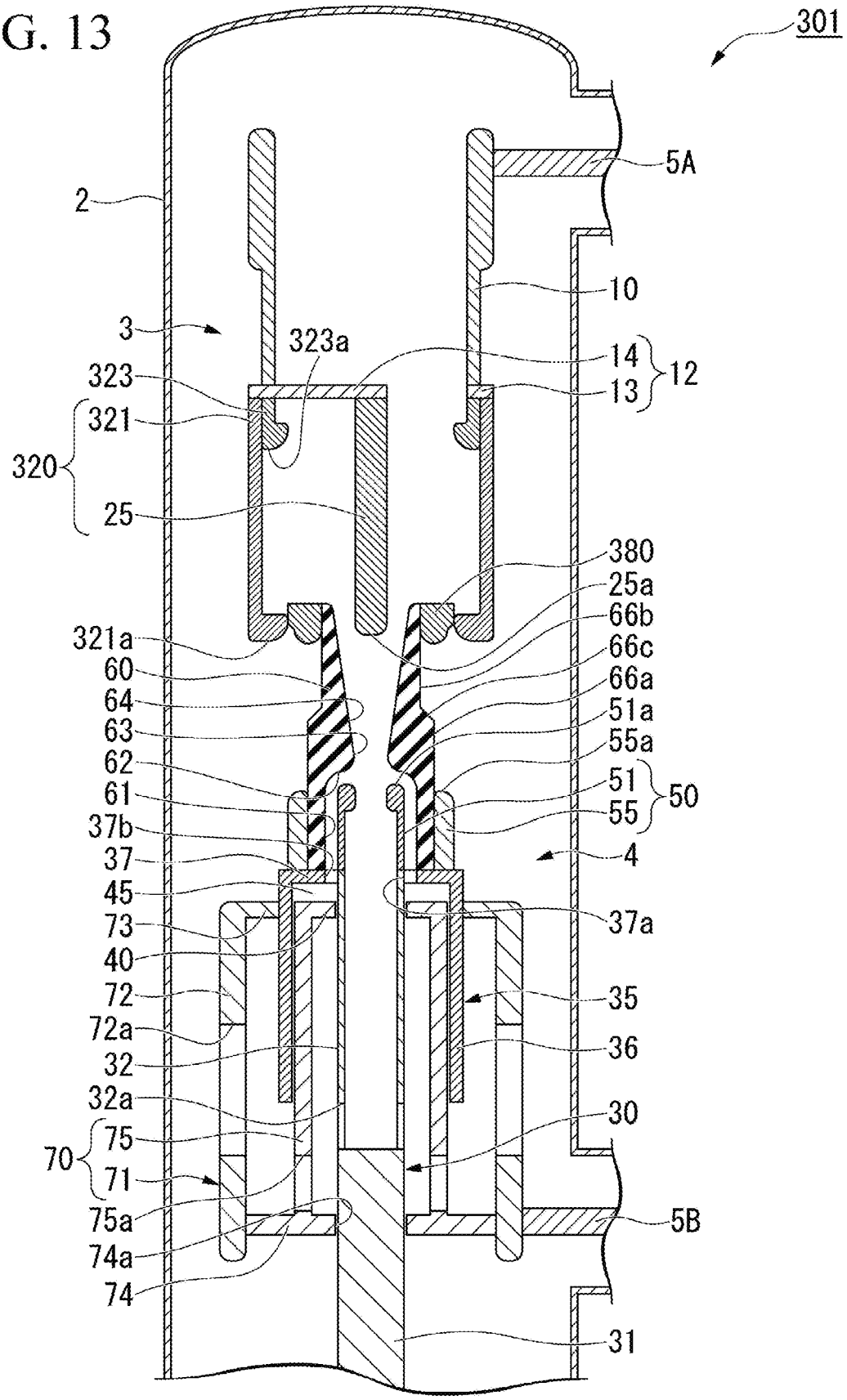
FIG. 13 is a cross-sectional view showing the gas circuit breaker of the second embodiment.

FIGS. 12 and 13 are cross-sectional views showing a gas circuit breaker of a second embodiment. Further, FIG. 12 shows a charging state of a gas circuit breaker 301, and FIG. 13 shows a completely open electrode state of the gas circuit breaker 301.

The gas circuit breaker 301 of the second embodiment shown in FIGS. 12 and 13 is distinguished from the gas circuit breaker 1 of the first reference aspect in that an electric field shield 380 comes into contact with a counter conduction contact 321 in the completely open electrode state. In addition, the gas circuit breaker 301 of the second embodiment is distinguished from the gas circuit breaker 1 of the first reference aspect in that the electric field shield 380 comes into contact with a shield contact 323 in a closed electrode state. Further, other components described below are the same as those of the first reference aspect.

As shown in FIG. 12, the gas circuit breaker 301 includes a counter contact part 320 and the electric field shield 380. The counter contact part 320 includes the counter conduction contact 321, the counter arc contact 25 and the shield contact 323.

The counter conduction contact 321 is formed of a metal material in a cylindrical shape. Both ends of the counter conduction contact 321 are open in the axial direction. The counter conduction contact 321 is formed to have a diameter that is slightly larger than that of the cooling tube 10. The counter conduction contact 321 is coupled to the end portion of the ring section 13 of the support 12 on the movable side. An end portion 321*a* of the counter conduction contact 321 on the movable side bulges inward in the radial direction. The counter conduction contact 321 is electrically connected to the cooling tube 10 via the support 12.

The shield contact 323 is formed of a metal material in a cylindrical shape. Both ends of the shield contact 323 are open in the axial direction. The shield contact 323 is formed such that it has the same diameter as that of the cooling tube 10. The shield contact 323 is disposed inside the counter conduction contact 321. An outer diameter of the shield contact 323 is substantially equal to an inner diameter of the counter conduction contact 321. The shield contact 323 is coupled to the end portion of the ring 13 of the support 12 on the movable side. An end portion 323*a* of the shield contact 323 on the movable side is provided closer to the anti-movable side than the end portion 321*a* of the counter conduction contact 321 on the movable side. The end portion 323*a* of the shield contact 323 on the movable side bulges inward in the radial direction. An inner diameter of the end portion 323*a* of the shield contact 323 on the movable side is equal to an inner diameter of the end portion 321*a* of the counter conduction contact 321 on the movable side. The shield contact 323 is electrically connected to the cooling tube 10 via the support 12.

The electric field shield 380 is attached to the end portion of the insulating nozzle 60 on the counter side. The electric field shield 380 is disposed between the end portion 321*a* of the counter conduction contact 321 on the movable side and the end portion 25*a* of the counter arc contact 25 on the movable side in the completely open electrode state (see FIG. 13). The electric field shield 380 is disposed at the same position as the end portion 323*a* of the shield contact 323 on the movable side in the axial direction in the charging state. An outer diameter of the electric field shield 380 is equal to an inner diameter of each of the end portion 321*a* of the counter conduction contact 321 on the movable side and the end portion 323*a* of the shield contact 323 on the movable side. Accordingly, the electric field shield 380 comes into contact with the inner circumferential surface of the counter conduction contact 321 in the completely open electrode state (see FIG. 13). In addition, the electric field shield 380 comes into contact with the inner circumferential surface of the shield contact 323 in the charging state (the closed electrode state). That is, the period of the separation process except the initial step (the charging state) and the final step (the completely open electrode state) is a non-contact period in which the electric field shield 380 does not come into contact with the counter conduction contact 321 and the shield contact 323. The electric field shield 380 has a floating potential in the non-contact period of the separation process while being electrically connected to the counter contact part 20 to have completely the same potential in the initial step and the final step of the separation process.

The electric field shield 380 is separated from the shield contact 323 in a state in which at least the counter arc contact 25 and the movable arc contact 51 come into contact with each other in the separation process. The electric field shield 380 has the same potential as that of the counter contact part 20 after a half cycle or more of the commercial frequency elapses from a time when the counter arc contact 25 and the movable arc contact 51 are separated from each other like the electric field shield 280 of the first embodiment. The electric field shield 380 does not come into contact with the counter contact part 20 until a half cycle or more of the commercial frequency elapses from a time when the counter arc contact 25 and the movable arc contact 51 are separated from each other.

According to the embodiment, the electric field shield 380 has a floating potential during a period except the initial step and the final step of the separation process. Accordingly, since the electric field shield 380 does not slide to the counter contact part 320 during the period except the initial and the final step of the separation process, a force in a direction opposite to the moving direction such as a frictional force or the like is not received. For this reason, a decrease in moving speed of the movable contact part 50 operated integrally with the electric field shield 380 is suppressed. Accordingly, a decrease in separation speed of the counter contact part 320 and the movable contact part 50 can be suppressed, and the insulating-proof pressure between the counter contact part 320 and the movable contact part 50 can be rapidly increased. Accordingly, the insulation breakdown between the counter contact part 320 and the movable contact part 50 can be suppressed, and the current cutoff performance of the gas circuit breaker 301 can be improved.

In addition, the electric field shield 380 has the same potential as that of the counter contact part 320 in the closed electrode state. Accordingly, the electric field shield 380 can be prevented from being charged in the charging state. Accordingly, in the separation process, occurrence of the insulation breakdown between the electric field shield 380 having the floating potential and the movable contact part 50 can be suppressed.

Figure 14:
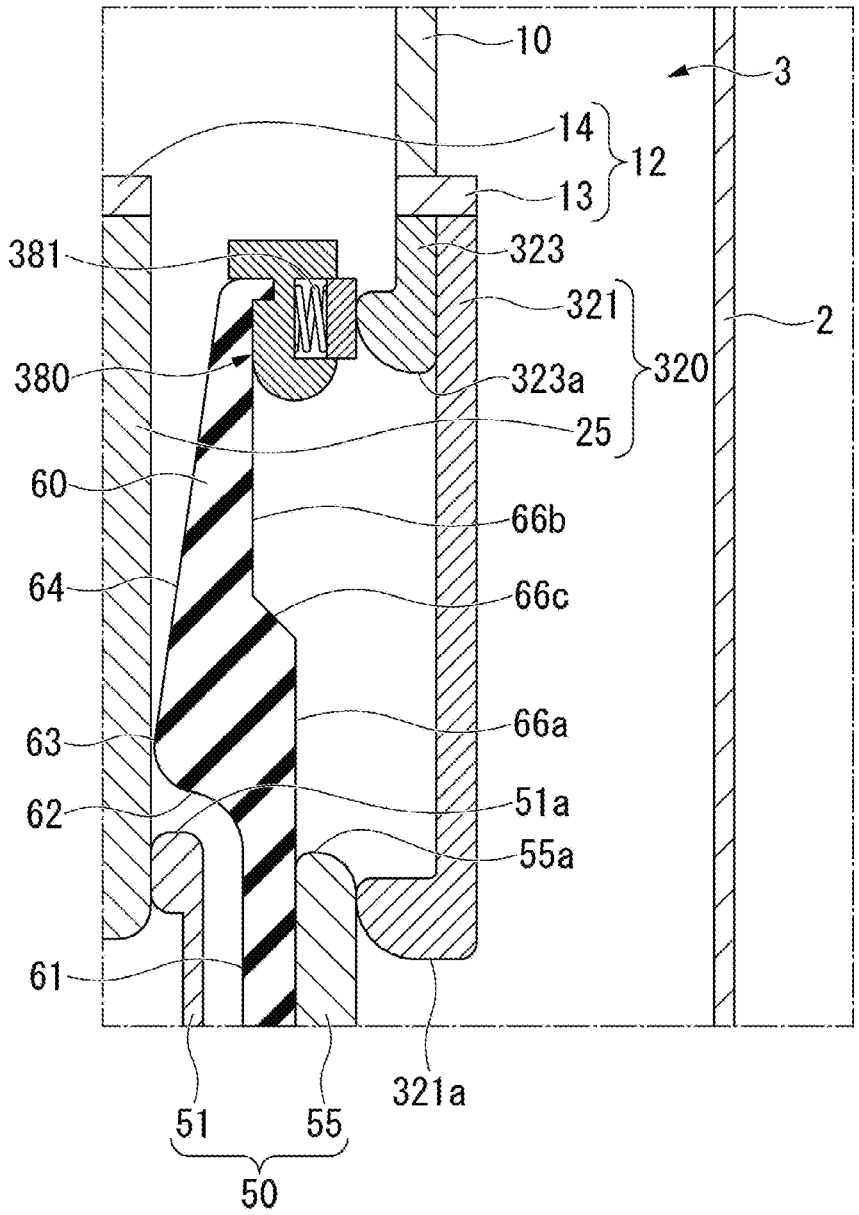
FIG. 14 is an enlarged cross-sectional view showing a gas circuit breaker of a modified example of the second embodiment.

Further, a conduction structure of the electric field shield 380 and the counter contact part 320 is not limited to an example shown in FIG. 12. For example, as shown in FIG. 14, part of the electric field shield 380 may be biased outward in the radial direction and pressure-welded to the shield contact 323 by a biasing member 381 having conductivity such as a coil spring, a leaf spring, or the like.

Figure 15:
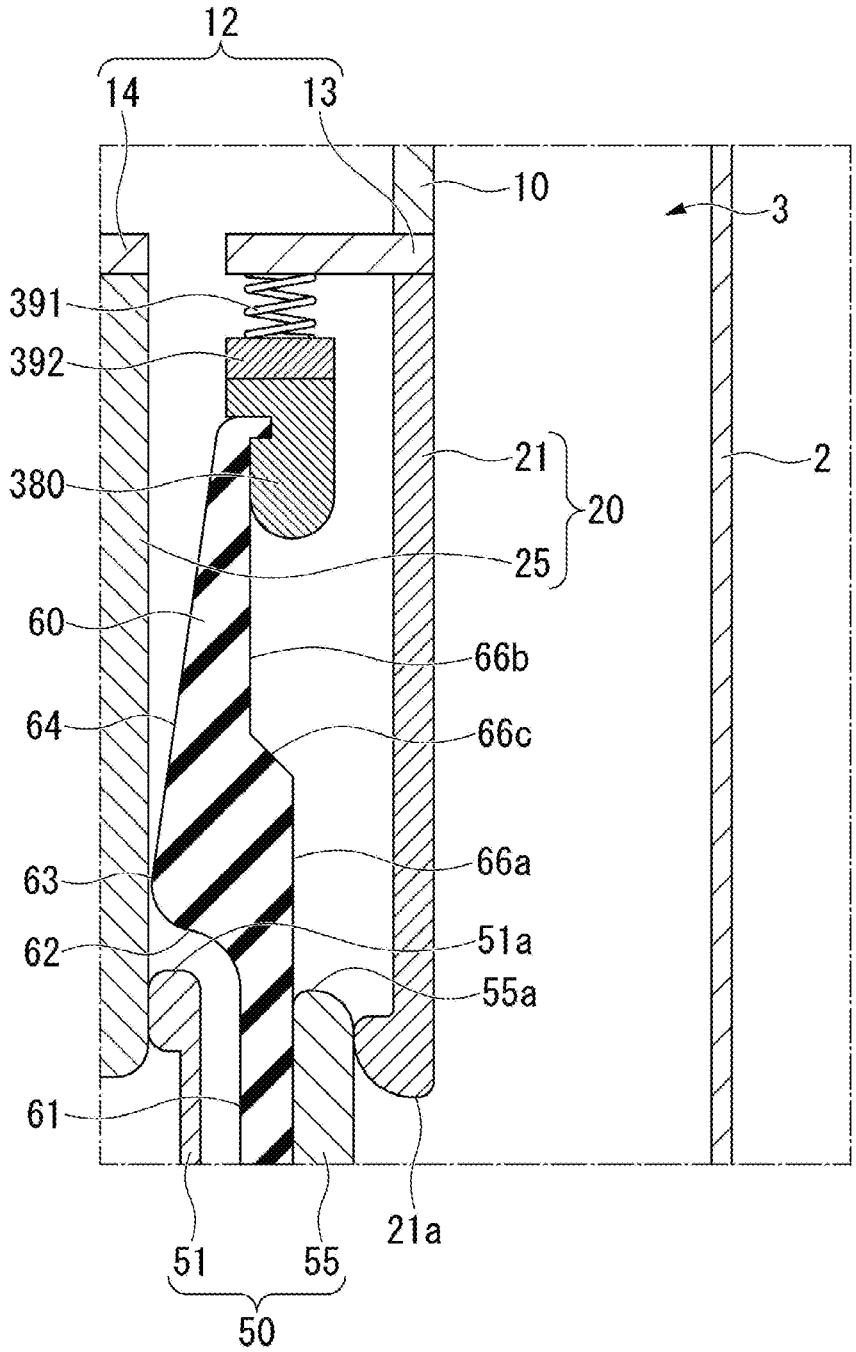
FIG. 15 is an enlarged cross-sectional view showing the gas circuit breaker of a modified example of the second embodiment.
Figure 16:
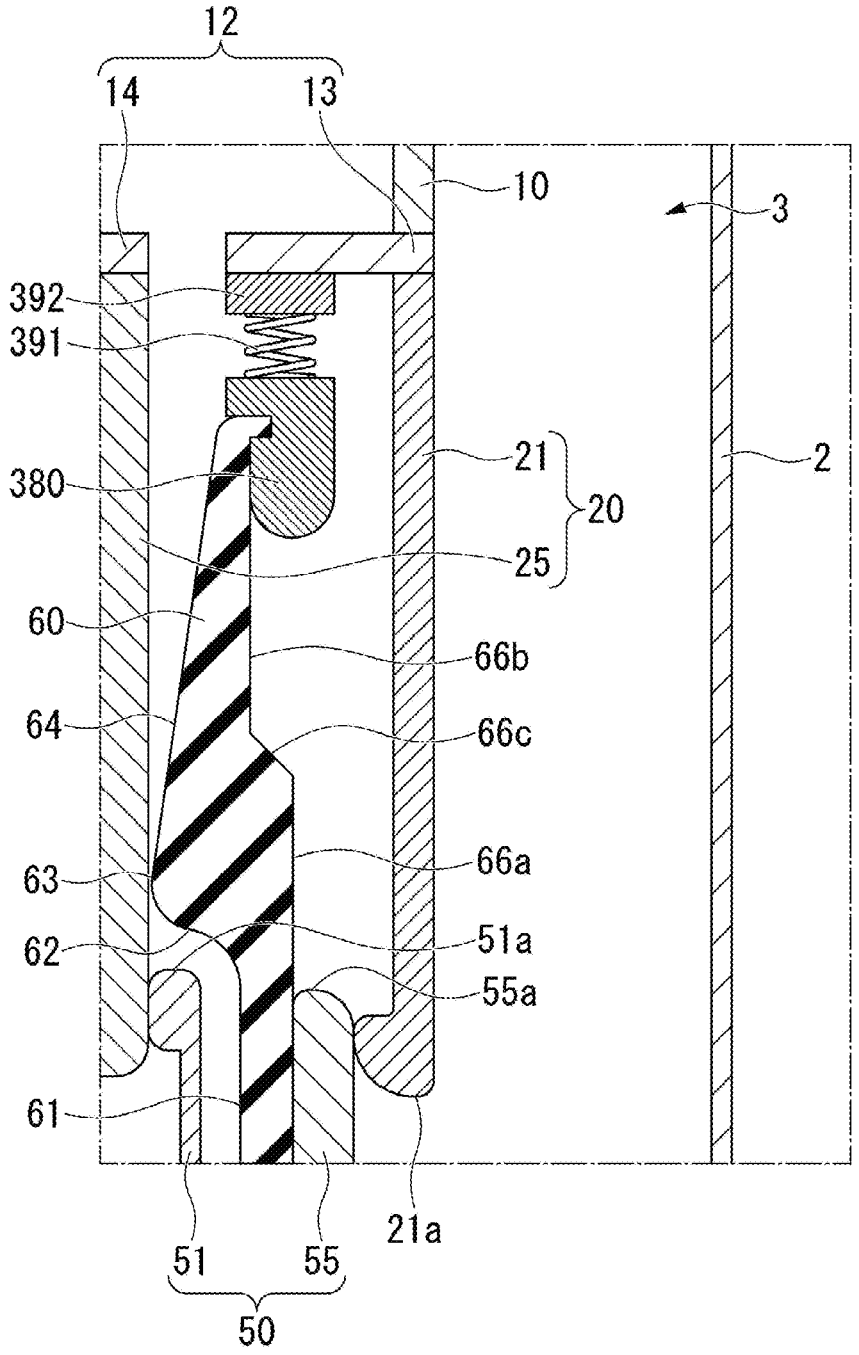
FIG. 16 is an enlarged cross-sectional view showing the gas circuit breaker of a modified example of the second embodiment.

In addition, as shown in FIGS. 15 and 16, the electric field shield 380 and the counter contact part 20 may be electrically connected to each other using a biasing member 391 having conductivity and expanded and contracted in the axial direction. Specifically, in the example shown in FIG. 15, the biasing member 391 and a conduction member 392 are disposed between the electric field shield 380 and the support 12. The conduction member 392 is disposed to face a surface of the electric field shield 380 that faces the counter side. A first end portion of the biasing member 391 is connected to the support 12. A second end portion of the biasing member 391 is connected to the conduction member 392. The biasing member 391 biases the conduction member 392 toward the electric field shield 380. Accordingly, the electric field shield 380 is electrically connected to the counter contact part 20 via the support 12.

In addition, in the example shown in FIG. 16, the conduction member 392 is disposed to face a surface of the support 12 that faces the movable side. The first end portion of the biasing member 391 is connected to the conduction member 392. The second end portion of the biasing member 391 is connected to the electric field shield 380. The biasing member 391 biases the conduction member 392 toward the support 12. Accordingly, the electric field shield 380 is electrically connected to the counter contact part 20 via the support 12. Further, even in any configuration shown in FIGS. 15 and 16, a natural length of the biasing member 391 is set such that the electric field shield 380 is not electrically connected to the counter contact part 20 at least in the open electrode state.

Third Embodiment

Figure 17:
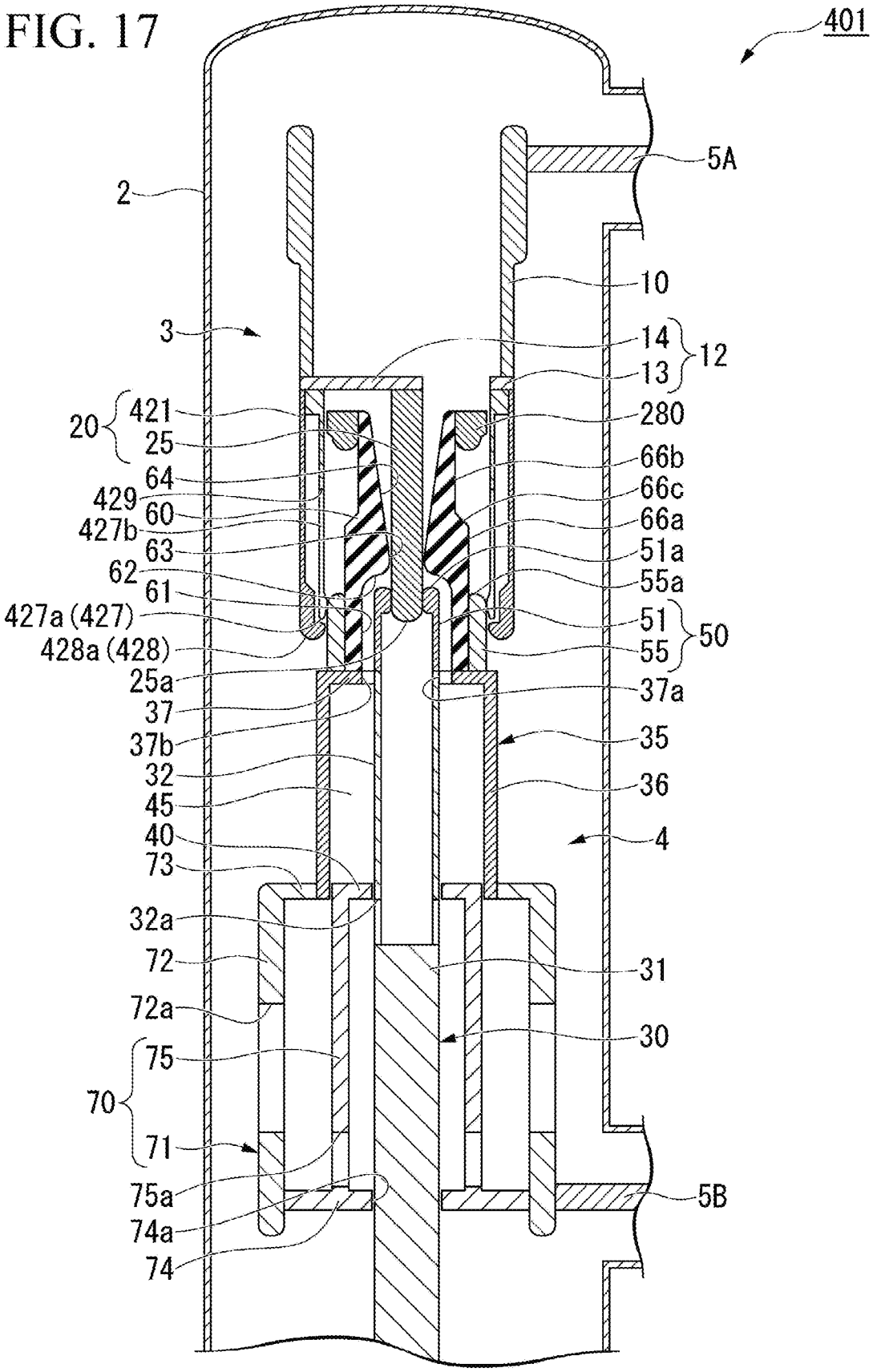
FIG. 17 is an enlarged cross-sectional view showing a gas circuit breaker of a third embodiment.
Figure 18:
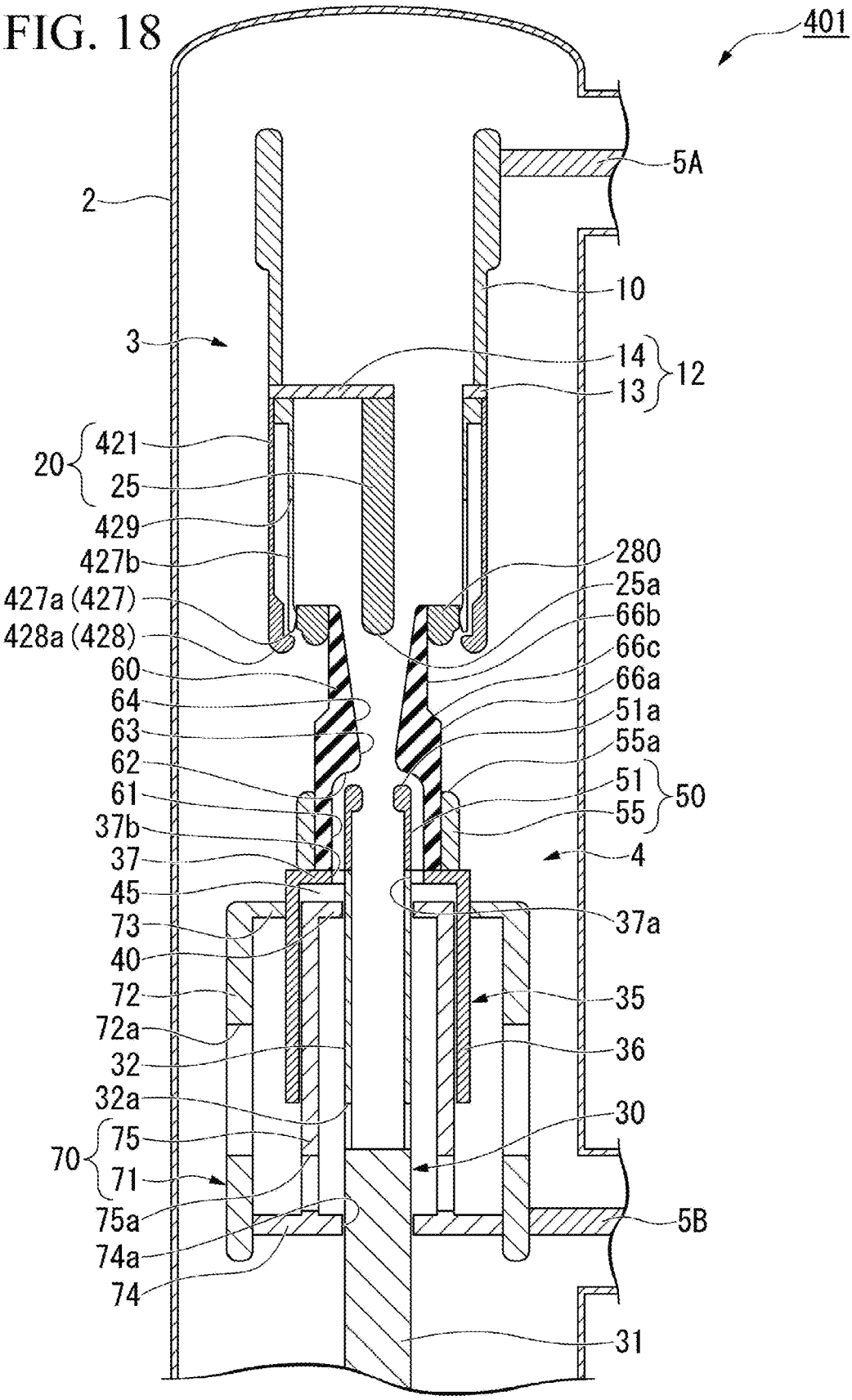
FIG. 18 is an enlarged cross-sectional view showing the gas circuit breaker of the third embodiment.

FIGS. 17 and 18 are cross-sectional view showing a gas circuit breaker of a third embodiment. Further, FIG. 17 shows a charging state of a gas circuit breaker 401, and FIG. 18 shows a completely open electrode state of the gas circuit breaker 401.

The gas circuit breaker 401 of the third embodiment shown in FIGS. 17 and 18 is distinguished from the gas circuit breaker 201 of the first embodiment in that a counter conduction contact 421 includes a conduction contact main body 427 and a conduction contact shield 428. Further, other components described below are the same as those in the first embodiment.

As shown in FIG. 17, the conduction contact main body 427 is formed of metal material in a cylindrical shape. Both ends of the conduction contact main body 427 are open in the axial direction. For example, the conduction contact main body 427 is formed to have a diameter that is slightly smaller than that of the cooling tube 10. The conduction contact main body 427 is coupled to the end portion of the ring section 13 of the support 12 on the movable side. The conduction contact main body 427 is electrically connected to the cooling tube 10 via the support 12.

A plurality of slits 429 are formed in the conduction contact main body 427. The plurality of slits 429 are cut toward the anti-movable side from an edge of the conduction contact main body 427 on the movable side. The plurality of slits 429 are formed at substantially equal intervals in the circumferential direction. Accordingly, the conduction contact main body 427 includes a plurality of fingers 427*b* provided between the neighboring slits 429. The fingers 427*b* are formed in leaf spring shapes and flexible deformable in the radial direction.

An end portion 427*a* of the conduction contact main body 427 on the movable side bulges inward in the radial direction. An inner diameter of the end portion 427*a* of the conduction contact main body 427 on the movable side is slightly smaller than an outer diameter of the movable conduction contact 55 and the electric field shield 280. The end portion 427*a* of the conduction contact main body 427 on the movable side is able to come into contact with the outer circumferential surface of the movable conduction contact 55 in the charging state as the fingers 427*b* are bent outward in the radial direction. In addition, the end portion 427*a* of the conduction contact main body 427 on the movable side is able to come into contact with the outer circumferential surface of the electric field shield 280 in the completely open electrode state as the fingers 427*b* are bent outward in the radial direction (see FIG. 18). An inner diameter of a portion of the conduction contact main body 427 except the end portion 427*a* on the movable side is larger than an outer diameter of the electric field shield 280. Accordingly, the electric field shield 280 comes into contact with the inner circumferential surface of the conduction contact main body 427 only in the completely open electrode state.

The conduction contact shield 428 is formed of a metal material in a cylindrical shape. Both ends of the conduction contact shield 428 are open in the axial direction. The conduction contact shield 428 is formed to have a diameter that is larger than that of the conduction contact main body 427. The conduction contact shield 428 is disposed to surround the conduction contact main body 427 from an outer side in the radial direction. The conduction contact shield 428 is coupled to the end portion of the ring 13 of the support 12 on the movable side. The conduction contact shield 428 is electrically connected to the conduction contact main body 427.

An end portion 428*a* of the conduction contact shield 428 on the movable side is formed to have a shape that surrounds the end portion 427*a* of the conduction contact main body 427 on the movable side. The end portion 428*a* of the conduction contact shield 428 on the movable side is provided closer to the movable side than the end portion 427*a* of the conduction contact main body 427 on the movable side. The end portion 428*a* of the conduction contact shield 428 on the movable side bulges inward in the radial direction. An inner diameter of the end portion 428*a* of the conduction contact shield 428 on the movable side is smaller than an outer diameter of the end portion 427*a* of the conduction contact main body 427 on the movable side. An inner diameter of the end portion 428*a* of the conduction contact shield 428 on the movable side is slightly larger than an outer diameter of the movable conduction contact 55 and the electric field shield 280.

According to the embodiment, the electric field shield 280 has a floating potential during a period except the final step of the separation process. In addition, the electric field shield 280 is electrically connected to the counter contact part 20 such that it has the same potential in the completely open electrode state. For this reason, the same effects as in the above-mentioned first embodiment can be exhibited.

Further, the conduction contact main body 427 of the counter conduction contact 421 is flexibly deformable in the radial direction. Accordingly, the movable conduction contact 55 and the electric field shield 280 can smoothly come into contact with and be separated from the counter conduction contact 421 formed in a hard metal material.

In addition, the counter conduction contact 421 includes the conduction contact shield 428 disposed to surround the conduction contact main body 427. Accordingly, an increase in electric field due to formation of the slits 429 in the conduction contact main body 427 can be attenuated.

However, the conduction contact shield is unnecessary, and the counter conduction contact 421 may include the conduction contact main body 427 only.

Fourth Embodiment

Figure 19:
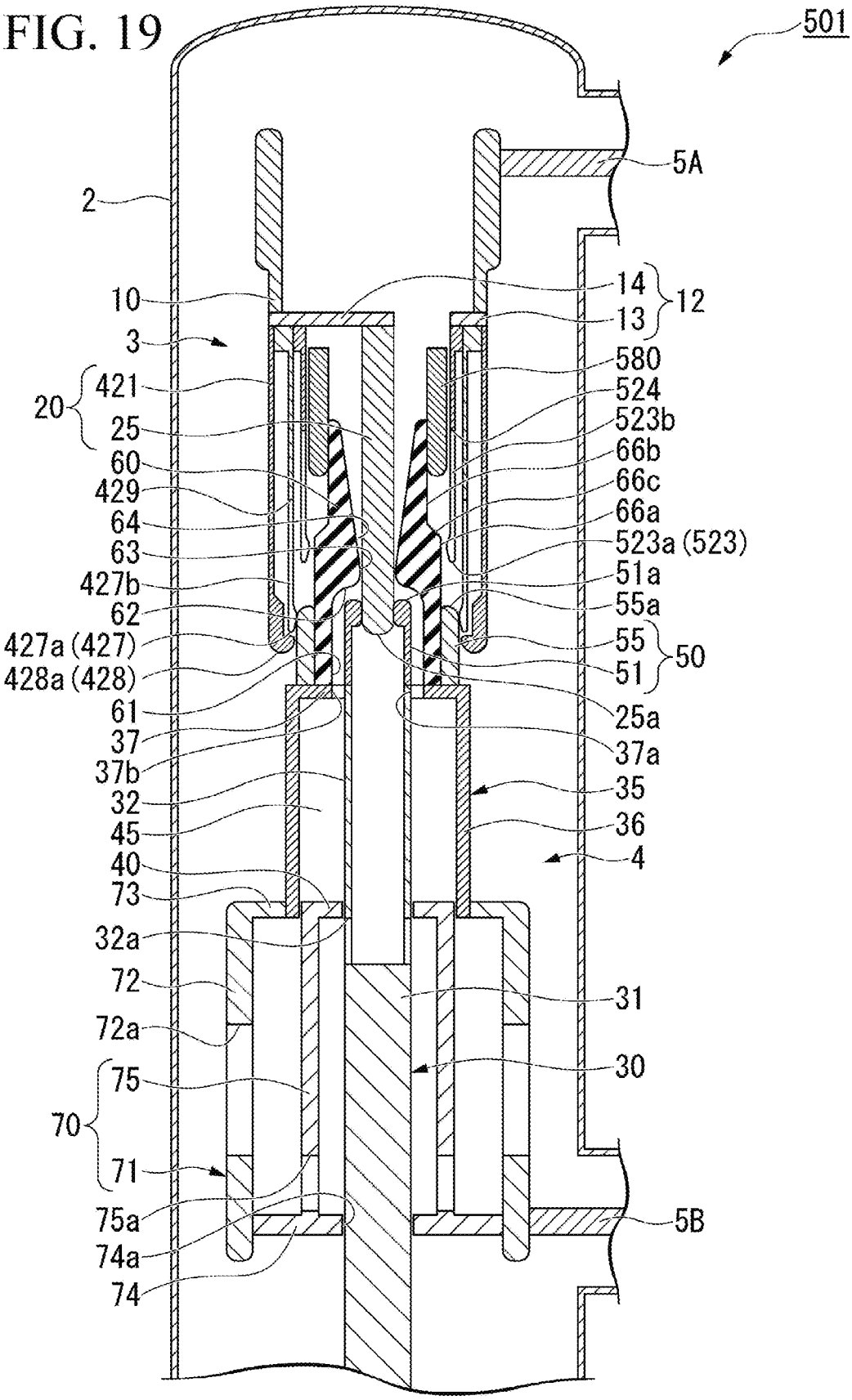
FIG. 19 is an enlarged cross-sectional view showing a gas circuit breaker of a fourth embodiment.
Figure 20:
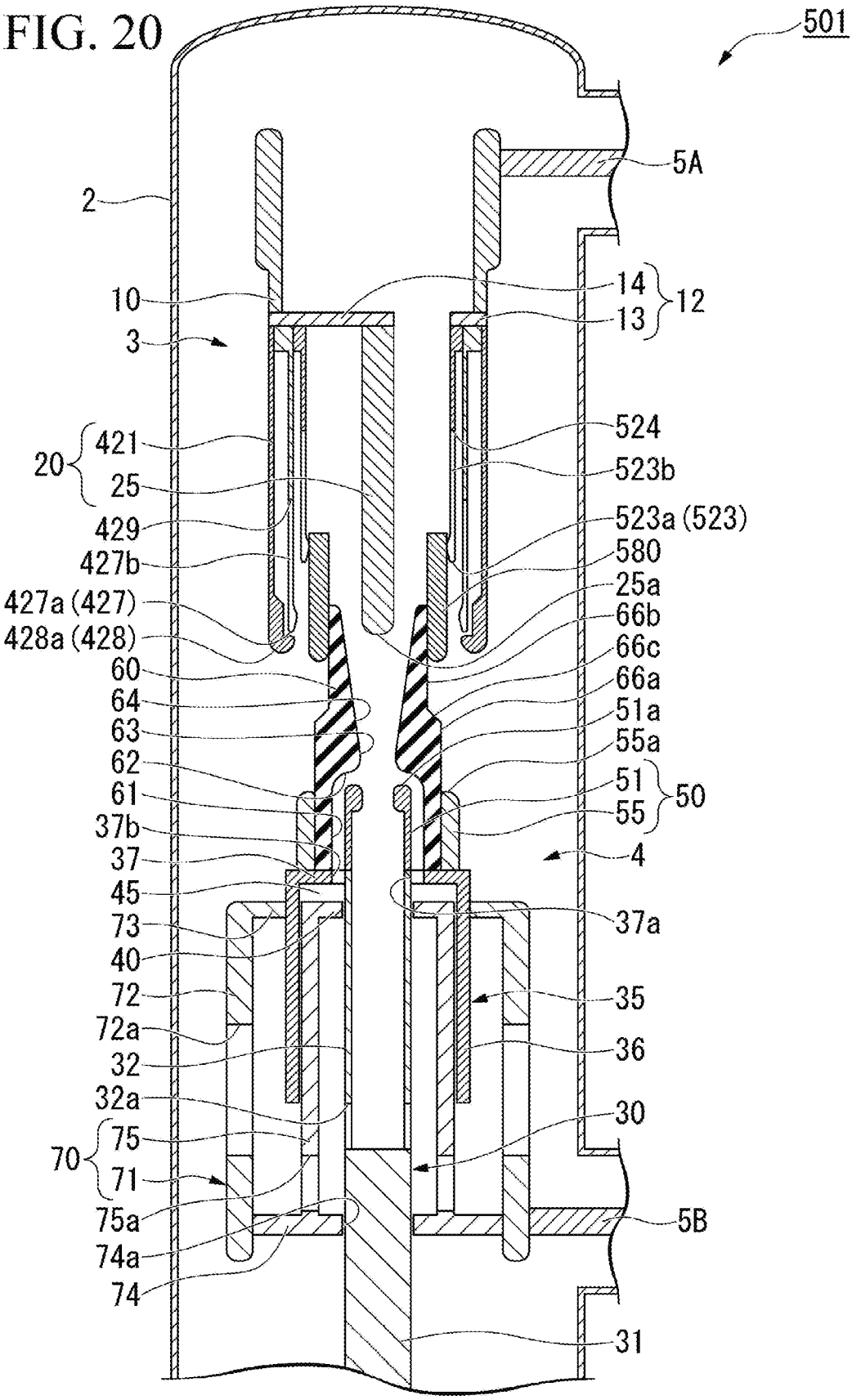
FIG. 20 is an enlarged cross-sectional view showing the gas circuit breaker of the fourth embodiment.

FIGS. 19 and 20 are cross-sectional views showing a gas circuit breaker of a fourth embodiment. Further, FIG. 19 shows a charging state of a gas circuit breaker 501, and FIG. 20 shows a completely open electrode state of the gas circuit breaker 501. The gas circuit breaker 501 of the fourth embodiment shown in FIGS. 19 and 20 is distinguished from the gas circuit breaker 401 of the third embodiment in that an electric field shield 580 is provided instead of the electric field shield 280 of the third embodiment. In addition, the gas circuit breaker 501 of the fourth embodiment is distinguished from the gas circuit breaker 401 of the third embodiment in that the electric field shield 580 comes into contact with a shield contact 523 without coining into contact with the counter conduction contact 421 in the completely open electrode state. Further, other components described below are the same as those in the third embodiment.

As shown in FIG. 19, the gas circuit breaker 501 includes the shield contact 523 and the electric field shield 580.

The shield contact 523 is formed of a metal material in a cylindrical shape. Both ends of the shield contact 523 are open in the axial direction. The shield contact 523 is formed to have a diameter that is smaller than that of the conduction contact main body 427 of the counter conduction contact 421. The shield contact 523 is disposed inside the conduction contact main body 427 to be surrounded by the conduction contact main body 427. The shield contact 523 is coupled to the end portion of the ring 13 of the support 12 on the movable side. The shield contact 523 is electrically connected to the cooling tube 10 via the support 12.

A plurality of slits 524 are formed in the shield contact 523. The plurality of slits 524 are cut toward the anti-movable side from an edge of the shield contact 523 on the movable side. The plurality of slits 524 are formed at substantially equal intervals in the circumferential direction. Accordingly, the shield contact 523 includes a plurality of fingers 523*b* provided between the neighboring slits 524. The fingers 523*b* are formed in leaf spring shapes and flexibly deformable in the radial direction.

An end portion 523*a* of the shield contact 523 on the movable side is provided closer to the anti-movable side than the end portion 427*a* of the conduction contact main body 427 on the movable side. The end portion 523*a* of the shield contact 523 on the movable side bulges inward in the radial direction. An inner diameter of the end portion 523*a* of the shield contact 523 on the movable side is smaller than an inner diameter of the end portion 427*a* of the conduction contact main body 427 on the movable side.

The electric field shield 580 is attached to the end portion of the insulating nozzle 60 on the counter side. The electric field shield 580 is formed in a cylindrical shape concentric with the insulating nozzle 60. The electric field shield 580 is attached to the outer circumferential surface of the insulating nozzle 60. The electric field shield 580 extends from the same position as the end portion of the insulating nozzle 60 on the counter side in the axial direction to the counter side. The electric field shield 580 is disposed closer to the counter side than the end portion 427*a* of the conduction contact main body 427 on the movable side in the charging state. The electric field shield 580 is disposed between the end portion 427*a* of the conduction contact main body 427 on the movable side and the end portion 25*a* of the counter arc contact 25 on the movable side in the completely open electrode state (see FIG. 20).

An outer diameter of the electric field shield 580 is smaller than an inner diameter of the end portion 427*a* of the conduction contact main body 427 on the movable side, and slightly larger than an inner diameter of the end portion 523*a* of the shield contact 523 on the movable side. Accordingly, the outer circumferential surface of the electric field shield 580 comes into contact with the inner circumferential surface of the shield contact 523 in the completely open electrode state (see FIG. 20). That is, the period of the separation process except the final step (the completely open electrode state) is a non-contact period in which the electric field shield 580 does not come into contact with the counter conduction contact 421. The electric field shield 580 has the floating potential in the non-contact period of the separation process while being electrically connected to the counter contact part 20 to have completely the same potential in the final step of the separation process.

Like the electric field shield 280 of the first embodiment, the electric field shield 580 has the same potential as that of the counter contact part 20 after a half cycle or more of the commercial frequency elapses from a time when the counter arc contact 25 and the movable arc contact 51 are separated from each other. The electric field shield 580 does not come into contact with the counter contact part 20 until the half cycle or more of the commercial frequency elapses from the time when the counter arc contact 25 and the movable arc contact 51 are separated from each other.

According to the embodiment, the electric field shield 580 has the floating potential in the period including at least the initial step of the separation process and except the final step. In addition, the electric field shield 580 is electrically connected to the counter contact part 20 such that it has the same potential at least in the completely open electrode state. For this reason, the same effects as in the above-mentioned first embodiment can be exhibited.

Further, while the electric field shield is formed in an annular shape in the above-mentioned embodiments, there is no limitation thereto. For example, the electric field shield may be provided in pieces in the circumferential direction.

In addition, while the counter unit 3 is fixed in position with respect to the sealed container 2 in the above-mentioned embodiments, there is no limitation thereto. The counter unit may be connected to the movable unit via a link or the like, and formed to be displaced toward the anti-movable side by displacing the operation rod to the anti-counter side.

In addition, while the insulating member 83 is disposed on the surface of the electric field shield 80 in the above-mentioned embodiments, there is no limitation thereto. That is, an insulating member may not be disposed on the surface of the electric field shield.

In addition, the components of the reference aspects may be appropriately combined with each of the above-mentioned embodiments. For example, a shape of the electric field shield 180 of the second reference aspect may be combined with the electric field shield 280 of the first embodiment. That is, the electric field shield 280 may be formed to be disposed between the end portion 21*a* of the counter conduction contact 21 on the movable side and the end portion 25*a* of the counter arc contact 25 on the movable side in the state in the middle of the separation process. Accordingly, the same effects as in the second reference aspect can be exhibited.

According to at least one embodiment described above, since the gas circuit breaker is attached to the insulating nozzle and the electric field shield having the floating potential in the period of at least the part of the separation process, the current cutoff performance can be improved, and reduction in size and low driving energizing can be achieved. Accordingly, it is possible to provide the gas circuit breaker having excellent current cutoff performance and capable of achieving reduction in size and low driving energizing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the inventions. The accompanying claims and their equivalents are intended to cover such forms or modifications as would fall within the scope of the inventions.

What is claimed is:

1. A gas circuit breaker comprising:

a sealed container filled with an arc-extinguishing gas;

a first contact part and a second contact part provided to come into contact with each other and be separated from each other in the sealed container in a predetermined direction and separated from each other in an open electrode state while coming into contact with each other in a closed electrode state;

an operation mechanism connected to the first contact part and configured to separate the first contact part and the second contact part from the closed electrode state to the open electrode state;

an insulating nozzle formed in a tubular shape and configured to surround arc discharge generated between the first contact part and the second contact part in the open electrode state while being displaced in conjunction with the first contact part in a separation process of the first contact part and the second contact part;

a pressure accumulator configured to discharge the arc-extinguishing gas to a flow path in the insulating nozzle to perform blasting with respect to the arc discharge while accumulating a pressure of the arc-extinguishing gas; and an electric field shield attached to the insulating nozzle, having a floating potential in a period of at least part of the separation process and electrically connected to the second contact part such that the electric field shield has the same potential in a completely open electrode state in which separation between the first contact part and the second contact part is terminated.

2. The gas circuit breaker according to claim 1, wherein the second contact part comprises a conduction contact formed in a tubular shape extending in the predetermined direction and configured to come into contact with the first contact part in the closed electrode state, and the electric field shield comes into contact with the conduction contact in the completely open electrode state.

3. The gas circuit breaker according to claim 1, wherein the electric field shield has the same potential as that of the second contact part after half a period or more with respect to a commercial frequency has elapsed after a time when the first contact part and the second contact part have been separated from each other in the separation process.

4. The gas circuit breaker according to claim 1, wherein the electric field shield does not come into contact with the second contact part until half a period or more of the commercial frequency elapses from a time when the first contact part and the second contact part are separated from each other in the separation process.

5. The gas circuit breaker according to claim 1, wherein the electric field shield has the same potential as that of the second contact part in the closed electrode state.

6. The gas circuit breaker according to claim 1, wherein the second contact part comprises:

a conduction contact formed in a tubular shape extending in the predetermined direction; and an arc contact disposed inside the conduction contact and extending in the predetermined direction, wherein the conduction contact and the arc contact each have a tip disposed in a direction in which the first contact part undergoes separation when seen from the second contact part in the predetermined direction, and the electric field shield is disposed between the tip of the conduction contact and the tip of the arc contact in the completely open electrode state.

7. The gas circuit breaker according to claim 1, wherein the second contact part comprises:

a conduction contact formed in a tubular shape extending in the predetermined direction; and an arc contact disposed inside the conduction contact and extending in the predetermined direction, wherein the conduction contact and the arc contact each have a tip disposed in a direction in which the first contact part is separated when seen in the second contact part in the predetermined direction, and the electric field shield is disposed between the tip of the conduction contact and the tip of the arc contact in a state in the middle of the separation process.

8. The gas circuit breaker according to claim 1, wherein an insulating member is disposed on a surface of the electric field shield.

9. The gas circuit breaker according to claim 1, wherein the arc-extinguishing gas is a material having a smaller global warming potential than that of sulfur hexafluoride.

10. The gas circuit breaker according to claim 1, wherein the electric field shield is formed of a metal material containing at least magnesium.

* * * * *